US006270178B1

(12) United States Patent
Wada et al.

(10) Patent No.: US 6,270,178 B1
(45) Date of Patent: Aug. 7, 2001

(54) METHOD AND APPARATUS FOR MEASURING THE AMOUNT OF DISCHARGED INK, PRINTING APPARATUS, AND METHOD OF MEASURING THE AMOUNT OF INK DISCHARGED IN THE PRINTING APPARATUS

(75) Inventors: Satoshi Wada, Machida; Nobuhito Yamaguchi, Inagi; Makoto Akahira, Kawasaki; Hideto Yokoi; Hiroshi Fujiike, both of Yokohama; Tadao Saito, Machida, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/987,388

(22) Filed: Dec. 9, 1997

Related U.S. Application Data

(63) Continuation-in-part of application No. 08/657,035, filed on May 29, 1996.

(30) Foreign Application Priority Data

May 30, 1995 (JP) ..... 7-131444
Apr. 25, 1996 (JP) ..... 8-105417
Dec. 19, 1996 (JP) ..... 8-339914

(51) Int. Cl.[7] ..... B41J 2/195; B41J 29/393
(52) U.S. Cl. ..... 347/7; 347/19
(58) Field of Search ..... 347/15, 19, 43, 347/7, 6, 14, 9; 358/504, 406

(56) References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/56 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,130,726 | 7/1992 | Fukushima et al. | 347/102 |
| 5,262,797 | 11/1993 | Boeller et al. | 346/25 |
| 5,384,859 | 1/1995 | Bolza-Schuenmann et al. | 347/19 |
| 5,387,976 | 2/1995 | Lesniak | 347/19 |
| 5,519,419 | 5/1996 | Stephany et al. | 347/19 |
| 5,528,270 | 6/1996 | Tajika et al. | 347/19 |
| 5,736,996 * | 4/1998 | Takada et al. | 347/19 |
| 5,798,771 * | 8/1998 | Nishii et al. | 347/7 |

FOREIGN PATENT DOCUMENTS

| | | |
|---|---|---|
| 288044 | 10/1988 | (EP) . |
| 0461759 | 12/1991 | (EP) . |
| 747224 | 12/1996 | (EP) . |
| 54-056847 | 5/1979 | (JP) . |
| 59-123670 | 7/1984 | (JP) . |
| 59-138461 | 8/1984 | (JP) . |
| 60-071260 | 4/1985 | (JP) . |
| 4276459 | 10/1992 | (JP) . |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A method of instantly measuring the amount of ink discharged from a nozzle of an ink-jet type printhead in a single discharging operation comprises: a density measuring step of measuring the density of an ink dot formed by ink discharged from the printhead onto a glass plate 10, and a determining step of determining the amount of the discharged ink on the basis of the density of the ink dot measured in the measuring step.

81 Claims, 17 Drawing Sheets

METHOD AND APPARATUS FOR MEASURING THE AMOUNT OF DISCHARGED INK, PRINTING APPARATUS, AND METHOD OF MEASURING THE AMOUNT OF INK DISCHARGED IN THE PRINTING APPARATUS

This is a continuation-in-part application of U.S. patent application Ser. No. 08/657,035 filed on May 29, 1996.

BACKGROUND OF THE INVENTION

The present invention relates to a method and an apparatus for measuring the amount of ink discharged, a printing apparatus-and a method of measuring the amount of ink discharged by the printing apparatus, and more particularly, to a method and an apparatus for measuring the amount of ink discharged by single discharging operation of a printhead, such as that used in an ink-jet printer, having fine nozzles which discharge a very small amount of ink from each nozzle.

For an apparatus such as the ink-jet printer which has a printhead consisting of a plurality of fine nozzles, it is quite important to control the amount of ink discharged from each nozzle to be uniform in order to stabilize printing quality. For this purpose, it is desired to correctly and instantly obtain the amount of ink discharged from each nozzle.

There are known methods of measuring a small amount of colored ink droplet (e.g., color ink), namely, (1) a weighing method and (2) an absorbance method.

Followings are explanation when the amount of ink discharged from a nozzle of an ink-jet printer is measured in the above two methods.

(1) Weighing Method

In this method, ink is discharged at a fixed interval for a predetermined time period, and the amount (weight) of used ink in the time period is measured by a chemical balance or the like (care must be taken to minimize vaporization vaporization of ink during this operation). Thereafter, by dividing the amount of ink used by the number of discharging operation performed, an average amount of ink droplet (an average discharging amount) in each discharging operation can be obtained.

(2) Absorbance Method

This method uses the relationship between concentration of solution and light absorption, which is known as Lambert-Beer's law. More specifically, solution having a certain concentration is poured into a transparent container having a fixed depth, and light having intensity $I_0$ is incidented on the container from one side, then intensity I of the light transmitted through the solution in the container is measured. Since a part of the incidented light is absorbed in the solution in the container, the intensity of the light reduces while passing the solution. It is known that the intensity is lowered in proportion to the concentration of the solution. Defining A as absorbance, the relationship of this law can be expressed in the following equation:

$$A=-\mathrm{Log}(I_0/I)=a\cdot b\cdot c$$

where a is a slope, b is the depth of the solution and c is the concentration of the solution. By using this equation, a calibration line showing the relationship between concentration and absorbance for the ink to be used is obtained in advance Next, ink is discharged from a nozzle toward a transparent solution of a known volume (a solution which has a light absorbance as small as possible is preferred), then absorbances by the solution containing discharged ink after each discharging operation, namely absorbances corresponding to the number of discharging operations, are measured. From the measured absorbances and the calibration line which was obtained in advance, the concentration of the solution including ink is determined. Then, the amount of ink mixed in the solution can be found by taking the amount of the original solution into consideration. The obtained amount of ink is divided by the number of discharging operations, thereby finding an average amount of ink discharged by each discharging operation.

However, according to the foregoing two conventional methods, there are problems in which a certain amount of ink has to be discharged; thus, it is impossible to instantly obtain the amount of ink discharged from each nozzle. As an experiment, the applicant of the present invention measured the amount of ink discharged per nozzle by the weighing method, and found that ink corresponding to 500,000 dots were discharged, and it took 12 minutes for the measurement. Thus, it takes quite a long time to measure the amount of ink discharged per nozzle of an ink-jet printer having an ink-jet printhead consisting of 64 or 128 fine nozzles. Furthermore, in the foregoing two methods, since the amount of ink per discharging operation is averaged, it is impossible to measure the real amount of ink discharged per nozzle in a single discharging operation.

SUMMARY OF THE INVENTION

The present invention has been made in consideration of the above situation, and has as its object to provide a method and apparatus for instantly measuring the amount of ink discharged from a nozzle.

Another object of the present invention is to provide a printing apparatus having the aforementioned measuring apparatus, and method of measuring the amount of discharged ink in the printing apparatus.

In order to solve the above-described problems and attain the objects, the method of measuring the amount of discharged ink according to the first aspect of the present invention is characterized by the following configuration.

More specifically, the method of measuring an amount of ink discharged from an ink-jet type printhead in a single discharging operation, comprises: a density measuring step of measuring a density of an ink dot formed by ink discharged from the printhead on a predetermined material; and a determining step of determining an amount of ink discharged on the basis of the density of the ink dot measured in the density measuring step.

Furthermore, the method of measuring the amount of discharged ink according to the second aspect of the present invention is characterized by the following configuration.

More specifically, the method of measuring an amount of ink discharged from an ink-jet type printhead in a single discharging operation, comprises: a preliminary measuring step of preliminarily measuring an amount of ink discharged from each of a plurality of ink-discharging nozzles of the printhead in a single discharging operation under a predetermined condition; a first density measuring step of measuring densities of ink dots made of ink discharged from at least two different ink-discharging nozzles which discharge different amounts of ink from each other out of the plurality of ink-discharging nozzles onto a predetermined material under the predetermined condition; a calibration line generating step of generating a calibration line representing correlation between an amount of ink discharged in a single discharging operation and a density of an ink dot on the basis of data on the densities of the ink dots, measured in the first density measuring step, formed with the ink discharged from the at least two ink-discharging nozzles and data on the amount of ink, measured in the preliminary measuring step, discharged from the at least two ink-discharging nozzles; a second density measuring step of measuring a density of an ink dot formed by ink discharged from an arbitrary nozzle of the printhead under an arbitrary condition; and a determining step of determining an amount of ink discharged from the arbitrary nozzle under the arbitrary condition on the basis of the data on the density of the ink dot, obtained in the second density measuring step, and the calibration line.

Furthermore, the apparatus for measuring the amount of discharged ink according to the first aspect of the present invention is characterized by the following configuration.

More specifically, the apparatus for measuring an amount of ink discharged from an ink-jet type printhead in a single discharging operation, the apparatus comprising: receiving medium for receiving ink discharged from the printhead; density determining means for determining a density of an ink dot formed by the discharged ink on the receiving medium; memory means for storing a calibration line representing correlation between an amount of ink discharged and a density of an ink dot formed by the discharged ink on the receiving medium in a single discharging operation; and operation means for finding an amount of the discharged ink on the basis of the density of the ink dot determined by the density determining means and the calibration line.

Furthermore, a printing apparatus according to the first aspect of the present invention is characterized by the following configuration.

More specifically, the printing apparatus having a function of measuring an amount of ink discharged from an ink-jet type printhead which prints by discharging ink from the ink-jet type printhead in a single discharging operation, comprises: density determination means for determining a density of an ink dot formed by ink discharged from the ink-jet type printhead on a receiving medium for receiving the discharged ink; memory means for storing a calibration line representing correlation between an amount of ink discharged and a density of an ink dot formed by the discharged ink on the receiving medium in a single discharging operation; and operation means for finding an amount of the discharged ink on the basis of the density of the ink dot determined by the density determining means and the calibration line.

Furthermore, the method of measuring the amount of ink discharged in the printing apparatus according to the first aspect of the present invention is characterized by the following configuration.

More specifically, the method of measuring an amount of ink discharged adopted by a printing apparatus having an ink-jet type printhead, comprises: a density measuring step of measuring a density of an ink dot formed by ink discharged from the printhead on a receiving medium for receiving the discharged ink; and a determining step of determining an amount of ink discharged on the basis of the density of the ink dot measured in the density measuring step.

Furthermore, the method of measuring the amount of ink discharged in the printing apparatus according to the second aspect of the present invention has the following configuration.

More specifically, the method of measuring an amount of ink discharged adopted by a printing apparatus having an ink-jet type printhead, comprises: a preliminary measuring step of preliminarily measuring an amount of ink discharged from each of a plurality of ink-discharging nozzles of the printhead in a single discharging operation under a predetermined condition; a first density measuring step of measuring densities of ink dots made of ink discharged from at least two different ink-discharging nozzles which discharge different amounts of ink from each other out of the plurality of ink-discharging nozzles onto a receiving medium for receiving ink under the predetermined condition; a calibration line generating step of generating a calibration line representing correlation between an amount of ink discharged in a single discharging operation and a density of an ink dot on the basis of data on the densities of the ink dots, measured in the first density measuring step, formed with the ink discharged from the at least two ink-discharging nozzles and data on the amount of ink, measured in the preliminary measuring step, discharged from the at least two ink-discharging nozzles; a second density measuring step of measuring a density of an ink dot formed by ink discharged from an arbitrary nozzle of the printhead under an arbitrary condition; and a determining step of determining an amount of ink discharged from the arbitrary nozzle under the arbitrary condition on the basis of the data on density of the ink dot, obtained in the second density measuring step, and the calibration line.

Furthermore, the method of measuring the amount of discharged ink according to the third aspect of the present invention is characterized by the following configuration.

More specifically, the method of measuring an amount of ink discharged from an ink-jet type printhead in a single discharging operation, comprises: a density measuring step of measuring a density of a line of a line pattern formed with ink discharged from the printhead on a predetermined material; and a determining step of determining an amount of ink discharged on the basis of the density of the line of the line pattern measured in the density measuring step.

Furthermore, the method of measuring the amount of discharged ink according to the fourth aspect of the present invention is characterized by the following configuration.

More specifically, the method of measuring an amount of ink discharged from an ink-jet type printhead in a single discharging operation, comprises: a preliminary measuring step of preliminary measuring an amount of ink discharged from each of a plurality of ink-discharging nozzles of the printhead in a single discharging operation under a predetermined condition; a first density measuring step of measuring densities of ink dots made of ink discharged from at least two different ink-discharging nozzles which discharge different amounts of ink from each other out of the plurality of ink-discharging nozzles onto a predetermined material under the predetermined condition; a calibration line generating step of generating a calibration line representing correlation between an amount of ink discharged in a single discharging operation and a density of an ink dot on the basis of data on the densities of the ink dots, measured in the first density measuring step, formed with the ink discharged from the at least two ink-discharging nozzles and data on the amount of ink, measured in the preliminary measuring step, discharged from the at least two ink-discharging nozzles; a second density measuring step of measuring a density of a line of a line pattern formed with ink discharged from an arbitrary nozzle of the printhead under an arbitrary condition; and a determining step of determining an amount of ink discharged from the arbitrary nozzle under the arbitrary condition on the basis of the data on the density of the line of the line pattern, obtained in the second density measuring step, and the calibration line.

Furthermore, the apparatus for measuring the amount of discharged ink according to the second aspect of the present invention is characterized by the following configuration.

More specifically, the apparatus for measuring an amount of ink discharged from an ink-jet type printhead in a single discharging operation, comprises: receiving medium for receiving ink discharged from the printhead; density determining means for determining a density of a line of a line pattern formed with the discharged ink on the receiving medium; memory means for storing a calibration line representing correlation between an amount of ink discharged and a density of an ink dot formed by the discharged ink on the receiving medium in a single discharging operation; and operation means for finding an amount of the discharged ink on the basis of the density of the line of the line pattern determined by the density determining means and the calibration line.

Still further, the method of measuring the amount of discharged ink according to the fifth aspect of the present invention is characterized by the following configuration.

More specifically, the method of measuring an amount of ink discharged from an ink-jet type printhead in a single discharging operation, comprises: a line pattern forming step of forming a line pattern on a predetermined material by discharging ink from the printhead onto the predetermined material; a first image-sensing step of sensing the line pattern by an image sensing device; a second image-sensing step of sensing a portion other than the line pattern on the predetermined material by the image sensing device; a density calculating step of calculating density of each pixel of the line pattern by dividing a luminance value of the portion sensed in the second image-sensing step by a luminance value of the line pattern sensed in the first image-sensing step pixel by pixel of the image sensing device, and calculating a common logarithm thereof; an integrating step of integrating the density of each pixel of the entire line pattern calculated in the density calculating step; and an ink-discharge-amount determining step of obtaining the amount of discharged ink on the basis of the integrated density calculated in the integrating step.

Furthermore, the method of measuring the amount of discharged ink according to the sixth aspect of the present invention is characterized by the following configuration.

More specifically, the method of measuring an amount of ink discharged from an ink-jet type printhead in a single discharging operation, comprises: a preliminary measuring step of preliminary measuring an amount of ink discharged from each of a plurality of ink-discharging nozzles of the printhead in a single discharging operation under a predetermined condition; a first density measuring step of measuring densities of ink dots made of ink discharged from at least two different ink-discharging nozzles which discharge different amounts of ink from each other out of the plurality of ink-discharging nozzles onto a predetermined material under the predetermined condition; a calibration line generating step of generating a calibration line representing correlation between an amount of ink discharged in a single discharging operation and a density of an ink dot on the basis of data on the densities of the ink dots, measured in the first density measuring step, formed with the ink discharged from the at least two ink-discharging nozzles and data on the amount of ink, measured in the preliminary measuring step, discharged from the at least two ink-discharging nozzles; a line pattern forming step of forming a line pattern on the predetermined material by discharging ink from an arbitrary nozzle of the printhead onto the predetermined material under an arbitrary condition; a first image-sensing step of sensing the line pattern by an image sensing device; a second image-sensing step of sensing a portion other than the line pattern on the predetermined material by the image sensing device; a density calculating step of calculating density of each pixel of the line pattern by dividing a luminance value of the portion sensed in the second image-sensing step by a luminance value of the line pattern sensed in the first image-sensing step pixel by pixel of the image sensing device, and calculating a common logarithm thereof; an integrating step of integrating the density of each pixel of the entire line pattern calculated in the density calculating step; and an ink-discharge-amount determining step of obtaining the amount of ink discharged from the arbitrary nozzle under the arbitrary condition on the basis of the integrated density calculated in the integrating step and the calibration line.

Furthermore, the apparatus for measuring the amount of discharged ink according to the third aspect of the present invention is characterized by the following configuration.

More specifically, the apparatus for measuring an amount of ink discharged from an ink-jet type printhead in a single discharging operation, comprises: a receiving medium for receiving ink discharged from the printhead; an image sensing device for sensing a line pattern, formed on the receiving medium with the discharged ink, and a portion other than the line pattern; first calculating means for calculating density of each pixel by dividing a luminance value of the portion other than the line pattern by a luminance value of the line pattern sensed by the image sensing device pixel by pixel, calculating a common logarithm and integrating the obtained density; memory means for storing a calibration line representing correlation between the amount of discharged ink and density of an ink dot formed on the receiving medium with discharged ink; and second calculating means for calculating the amount of discharged ink on the basis of the integrated density of the line pattern obtained by the first calculating means and the calibration line.

Furthermore, the apparatus for measuring the amount of discharged ink according to the second aspect of the present invention is characterized by the following configuration.

More specifically, the printing apparatus, having a function for measuring an amount of ink discharged from an ink-jet type printhead in a single discharging operation, for performing printing by utilizing the ink-jet printhead which discharges ink by ink-jet method, comprises: a receiving medium for receiving ink discharged from the printhead; an image sensing device for sensing a line pattern, formed on the receiving medium with the discharged ink, and a portion other than the line pattern; first calculating means for calculating density of each pixel by dividing a luminance value of the portion other than the line pattern by a luminance value of the line pattern sensed by the image sensing device pixel by pixel, calculating a common logarithm and integrating the obtained density; memory means for storing a calibration line representing correlation between the amount of discharged ink and density of an ink dot formed on the receiving medium with discharged ink; and second calculating means for calculating the amount of discharged ink on the basis of the integrated density of the line pattern obtained by the first calculating means and the calibration line.

Furthermore, the method of measuring the amount of ink discharged in the printing apparatus according to the third aspect of the present invention is characterized by the following configuration.

More specifically, the method of measuring an amount of discharged ink in a printing apparatus having an ink-jet type printhead, comprises: a line pattern forming step of forming a line pattern on a predetermined material by discharging ink from the printhead onto the predetermined material; a first image-sensing step of sensing the line pattern by an image sensing device; a second image-sensing step of sensing a portion other than the line pattern on the predetermined material by the image sensing device; a density calculating step of calculating density of each pixel of the line pattern by dividing a luminance value of the portion sensed in the second image-sensing step by a luminance value of the line pattern sensed in the first image-sensing step pixel by pixel of the image sensing device, and calculating a common logarithm thereof; an integrating step of integrating the density of each pixel of the entire line pattern calculated in the density calculating step; and an ink-discharge-amount determining step of obtaining the amount of discharged ink on the basis of the integrated density calculated in the integrating step.

Furthermore, the method of measuring the amount of ink discharged in the printing apparatus according to the fourth aspect of the present invention is characterized by the following configuration.

More specifically, the method of measuring an amount of ink discharged in a printing apparatus having an ink-jet type printhead, comprises: a preliminary measuring step of preliminary measuring an amount of ink discharged from each of a plurality of ink-discharging nozzles of the printhead in a single discharging operation under a predetermined condition; a first density measuring step of measuring densities of ink dots made of ink discharged from at least two different ink-discharging nozzles which discharge different amounts of ink from each other out of the plurality of ink-discharging nozzles onto a predetermined material under the predetermined condition; a calibration line generating step of generating a calibration line representing correlation between an amount of ink discharged in a single discharging operation and a density of an ink dot on the basis of data on the densities of the ink dots, measured in the first density measuring step, formed with the ink discharged from the at least two ink-discharging nozzles and data on the amount of ink, measured in the preliminary measuring step, discharged from the at least two ink-discharging nozzles; a line pattern forming step of forming a line pattern on the predetermined material by discharging ink from an arbitrary nozzle of the printhead onto the predetermined material under an arbitrary condition; a first image-sensing step of sensing the line pattern by an image sensing device; a second image-sensing step of sensing a portion other than the line pattern on the predetermined material by the image sensing device; a density calculating step of calculating density of each pixel of the line pattern by dividing a luminance value of the portion sensed in the second image-sensing step by a luminance value of the line pattern sensed in the first image-sensing step pixel by pixel of the image sensing device, and calculating a common logarithm thereof; an integrating step of integrating the density of each pixel of the entire line pattern calculated in the density calculating step; and an ink-discharge-amount determining step of obtaining the amount of ink discharged from the arbitrary nozzle under the arbitrary condition on the basis of the integrated density calculated in the integrating step and the calibration line.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follows the description for determining the scope of the invention.

BRIEF DESCRIPTION OF THE DRAWINGS

The accompanying drawings, which are incorporated in and constitute a part of the specification, illustrate embodiments of the invention, and together with the description, serve to explain the principles of the invention.

DETAILED DESCRIPTION OF THE PREFERRED EMBODIMENTS

Preferred embodiments of the present invention will be described in detail in accordance with the accompanying drawings.

(First Embodiment)

Figure 1:
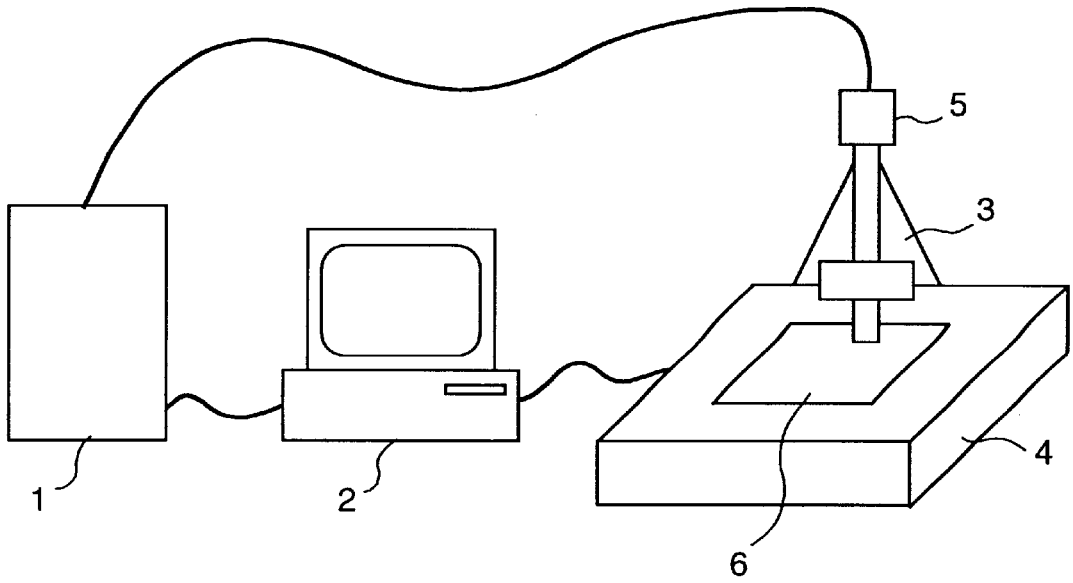
FIG. 1 shows a configuration of an apparatus for measuring the amount of discharged ink according to the first embodiment of the present invention.

FIG. 1 depicts a configuration of an apparatus for measuring the amount of ink discharged according to the first embodiment of the present invention. In FIG. 1, reference numeral 1 denotes an image processing unit for measuring density (it may be referred to as tint) of an ink dot (simply referred as "dot", hereinafter); 2, a personal computer (referred as "PC", hereinafter) used for controlling the image processing unit 1 and an XY control stage 4; 3, an optical microscope; 4, the XY control stage to be used when the density of object to be measured is continuously measured; 5, a color CCD camera for inputting an image of the object to be measured into the image processing unit 1; and 6, a light source placed under the XY control stage 4. The central part of the surface of the XY control stage 4 is made of glass, and the object to be measured is illuminated by the light source placed underneath of the glass and an object image can be inputted from the color CCD camera 5. The PC 2 controls the XY control stage 4 through RS232C or GPIB interface as well as controls the image processing unit 1.

Figure 2:
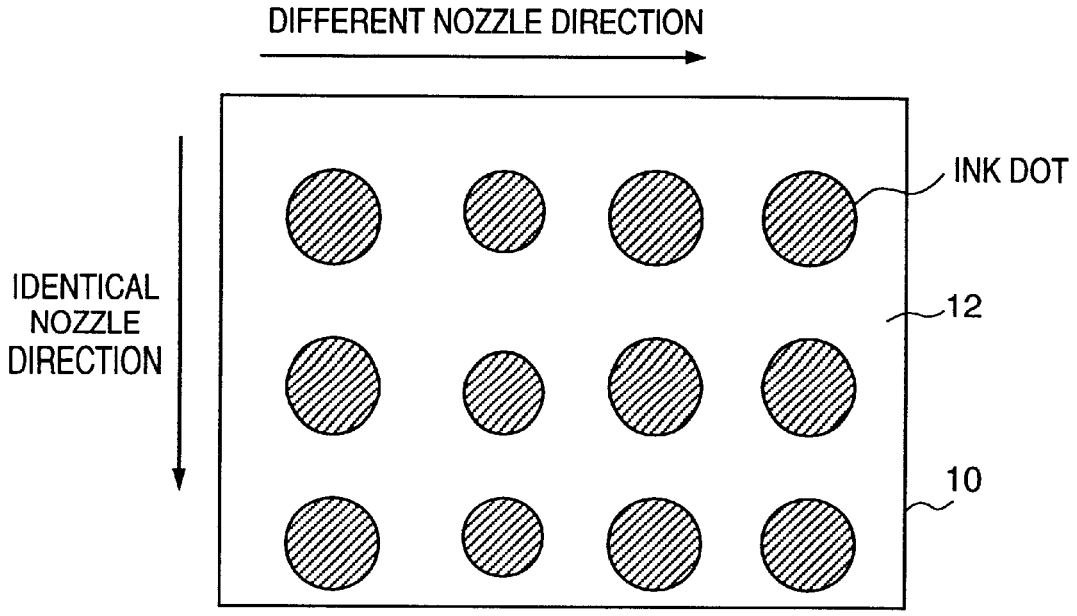
FIG. 2 shows an example of a dot pattern printed by using an ink-jet printer.

FIG. 2 is an example when a plurality of nozzle of an ink-jet printer discharge ink on a transparent glass plate 10 three times. Further, "same nozzle direction" in FIG. 2 indicates the direction of ink dots discharged from an identical nozzle, and "different nozzle direction" indicates the direction of ink dots discharged from a plurality of different nozzles in a single discharging operation. It should be noted that, since ink and glass are incompatible with each other, a special process for mediating between the discharged ink and the glass plate 10 is to be necessarily applied on the glass plate 10 (the glass plate is coated with polyvinyl alcohol to form an ink-absorbent layer 12 in this example). With this process, ink discharged from each nozzle in a single discharging operation is uniformly absorbed by the ink-absorbent layer 12 and forms a round-shaped dot. As for the material of the ink-absorbent layer 12, a material which is as transparent and colorless as possible (i.e., which do not absorb light) is preferred.

Under the conditions in which the microscope 3 focuses on an arbitrary one of the dots printed as shown in FIG. 2 and the magnification of the microscope 3 and the intensity of the light source 6 are properly adjusted, an image of the focused dot is inputted by the color CCD camera 5 to the image processing unit 1. In the image processing unit 1 used in this embodiment, a single color image can be decomposed into images of red (R), green (G) and blue (B) which are the three primary colors of light of optics, to form three monochromatic images, namely, a monochromatic image representing luminance level of light in the red (R) wavelength range, a monochromatic image representing luminance level of light in the green (G) wavelength range, and a monochromatic image representing luminance level of light in the blue (B) wavelength range. These monochromatic images are formed with minimal pixel units to which the image processing unit 1 can resolve, and each minimal pixel can express luminance level in 256 tones, between 0 and 255 tone, in accordance with the intensity of the transmitted light through each pixel.

Next, a method of measuring density of a dot will be explained.

In this embodiment, the density of a dot is determined by how much the incidented light (white light) is absorbed while transmitting through a dot with color (density) which is subjected to measurement. The higher the density of a dot subjected to measurement, the more the light is absorbed, and the intensity of the transmitted light is decreased. Therefore, the luminance level of the minimum pixel in an area of the dot subjected to measurement decreases. Contrarily, if the density of the dot is low, then the luminance level of the minimum pixel must be high. This embodiment focuses on this fact, and the density is replaced by light absorbances (although what the image processing unit 1 actually measures is a luminance level).

For example, in a case of measuring the light absorbance of a dot, printed with red ink, subjected to measurement, since the red dot transmits red light, in a monochromatic image which is responsive for red light the dot looks as blight as its surrounding. Thus, it is impossible to measure the density of the red dot in a monochromatic image which is responsive for red light. In contrast, in a monochromatic image which is responsive for blue light, as the density of the dot becomes higher, less blue light is transmitted. Accordingly, the intensity of the transmitted light changes depending upon changes of the density of the dot, thus the density of the dot can be measured in a monochromatic image which is responsive for blue light. Therefore, a band-pass filter which selectively transmits light in the blue wavelength range is provided over a dot printed with red ink, and the luminance level of the transmitted light is measured in the monochromatic image which shows luminance levels of light in the blue wavelength range. It should be noted that there is a method of measuring the density of the dot printed with red ink by using the green monochromatic image, however, it is considered most preferable to measure the luminance level of the red dot in the blue monochromatic image since the overlapping wavelength range between the red wavelength range and the green wavelength range is wider than the overlapping wavelength range between the red wavelength range and the blue wavelength range.

In this embodiment, a dot pattern to be measured shown in FIG. 2 are printed with blue ink on the glass plate 10. Therefore, luminance levels of the dots are measured in the red monochromatic image because of the aforesaid reason.

Figure 3:
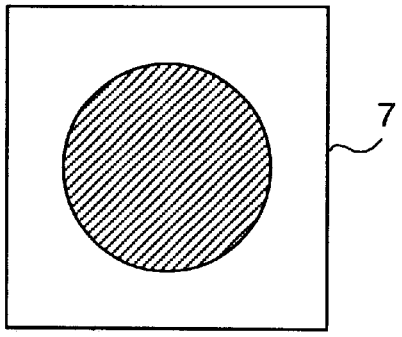
FIG. 3 shows an example when an ink dot subjected to measurement marked by a window.

Then, an image of a pixel subjected to measurement inputted as described above is marked with a fixed sized frame (called "window", hereinafter) as shown in FIG. 3. Basically, it is preferred to sum up all the luminance levels inside of the minimal pixels of the dot to measure its density, However, when the dot is actually observed by the microscope, it is very difficult to determine the border between the dot and background since the density in the edge part of the dot is low. Therefore, a window whose size is large enough to surely includes the entire dot subjected to measurement (including its surrounding) is used to specify an area, then all the luminance levels of the minimal pixels in the window are summed up. The sum is considered as the total luminance of the dot subjected to measurement.

The window size can be arbitrarily determined in consideration with the size of a dot subjected to measurement. However, if the window size is set too large, the luminance level in too large a background area which is essentially nothing to do with the dot density is included, which degrades accuracy of the measured data. Therefore, too large a window size is not preferable.

Prior to finding the total luminance of the dot shown in FIG. 3, a part which does not include a printed dot (i.e., a part where only the ink-absorbent layer 12 exists) is first marked by the window, and the total luminance inside of the window is measured. This total luminance is defined as a reference total luminance which indicates a state in that light absorbance is the minimum (i.e., minimum density). Then, the actually measured total luminance of the dot subjected to measurement is divided by the reference total luminance, then the reciprocal of the quotient or the logarithm of the reciprocal is defined as the absorbance (density data) of the dot subjected to measurement.

Next, a method of finding a calibration line which is to be the reference for measuring the amount of ink discharged from an arbitrary nozzle of an ink-jet head in a single discharging operation under arbitrary conditions will be described below. In the explanation below, an amount of ink discharged in a single discharging operation usually indicates an ink droplet. However, since there are cases in which the ink does not form a droplet, thus an expression, "an amount of ink discharged in a single discharging operation" is used instead of "an ink droplet".

As the first process, amounts of ink discharged from at least two different nozzles which discharge different amounts of ink from each other as much as possible among a plurality of nozzles of an ink-jet head, subjected to measurement of amount of ink discharged, in a single discharging operation under a fixed condition are measured by using the weighing method or the absorbance method which have been described as the prior arts.

In this embodiment, the amounts of ink discharged from four different nozzles which are known to discharge different amounts of ink in a single discharging operation under a fixed condition are measured in advance by using the weighing method.

Next, ink is discharged again under the same condition as that the discharging amounts are measured as above from the four nozzles whose discharging amounts of ink in a single discharging operation have been found as above, and the densities of the ink dots formed with the discharged ink on the glass plate is measured in the aforesaid method. By performing this measurement, the amounts of ink discharged from the four nozzles and the densities of the ink dots formed with the discharged ink can be found in one-to-one relationship. Note, the density data of ink dots printed by the four nozzles were found as averages of sampled densities of 50 dots printed. Standard deviation of the density data in the aforesaid measurement was within 5% with respect to the averages.

Figure 4:
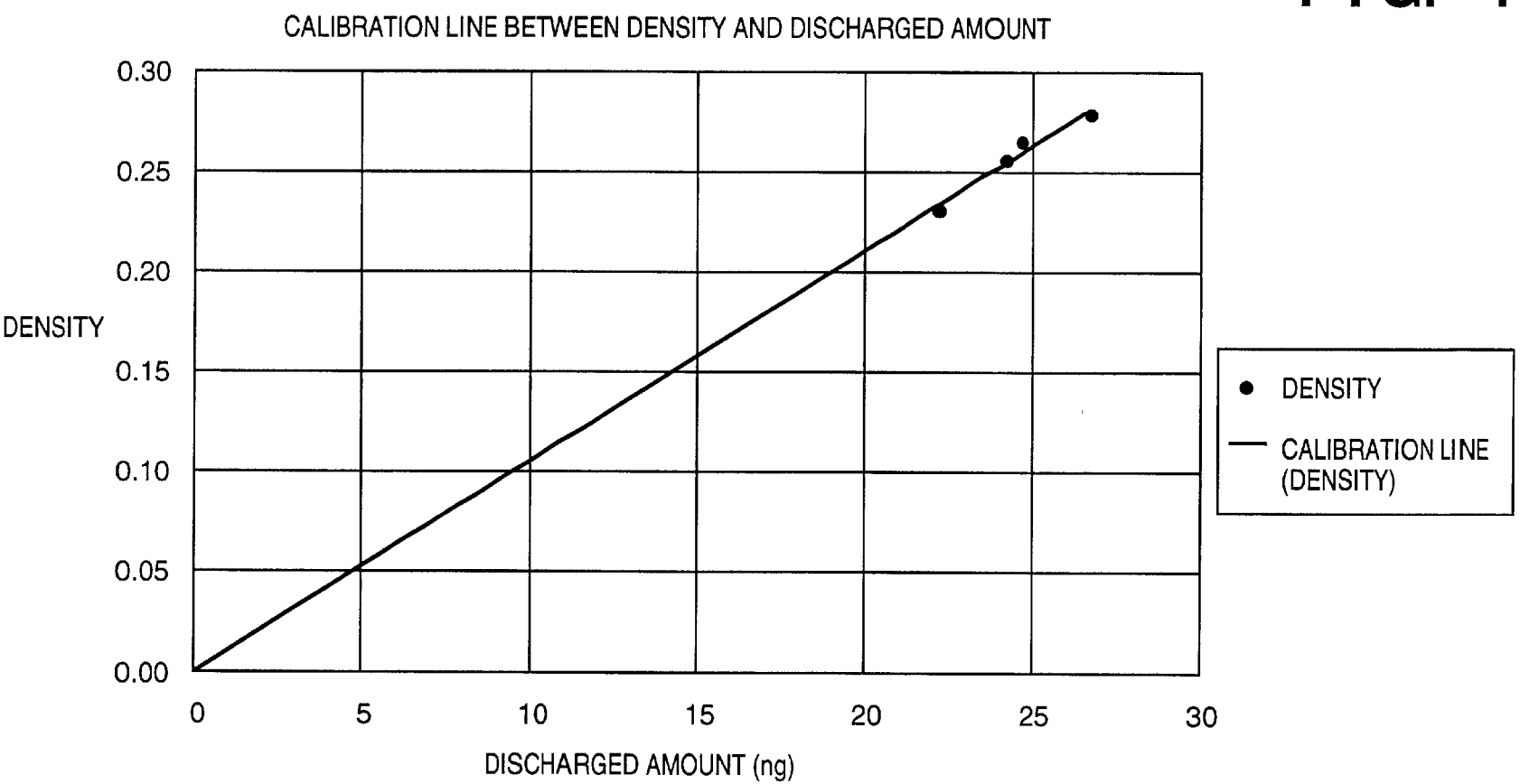
FIG. 4 is an example of a calibration line based on an experiment according to embodiments.

FIG. 4 is a graph of densities of ink dots formed on the glass plate 10 with respect to amounts of ink, forming the ink dot, discharged in each discharging operation of four nozzles. In FIG. 4, small black points show the densities of ink dots with respect to the amounts of ink discharged from the four nozzles. As seen in this graph, four points are approximately on a single straight line. Therefore, by drawing a straight line which fits the four points and using it, density of an ink dot corresponding to an arbitrary amount of ink discharged can be found based on the straight line in one-to-one relationship. This straight line is called a "calibration line".

It should be noted that, since the calibration line is expressed by a straight line, at least two points on the graph are necessary to plot the calibration line. Therefore, it is possible to find the calibration line by using minimum of two nozzles, instead of using four nozzles as above. However, since data of amount of ink discharged measured by using either the weighing method or the absorbance method is used to find the calibration line, the accuracy of the used measuring method directly affects the method of measuring an amount of ink discharged in this embodiment. Therefore, it is considered to be preferable to use more than two nozzles to find the calibration line. Further, the calibration line needs to be independently measured each time when ink to be used is changed.

Thereafter, by measuring the density of a dot formed with ink discharged from an arbitrary nozzle under an arbitrary condition in the aforesaid method, it is possible to find the amount of ink discharged from the nozzle by referring to the calibration line.

Further, it is possible to sequentially measure the densities of dots by controlling the XY control stage 4 by using the PC 2. For example, dots are printed at an interval as shown in FIG. 2, series of dots are arraigned on the XY control stage 4, and pitches of movement in the X and Y directions are designated. Accordingly, densities of dots printed by an identical nozzle or densities of dots printed by different nozzles can be sequentially measured. Then, an equation for converting the density to the discharged amount is found in advance in accordance with the calibration line obtained in advance. Accordingly, by using the equation, data obtained by measuring the density of a dot can be instantly converted to data of amount of ink discharged by using the PC 2. It should be noted that the data of the obtained calibration line is stored in a memory of the PC 2.

Next, a printing apparatus having the aforesaid function for measuring amount of ink discharged will be described below.

Figure 5:
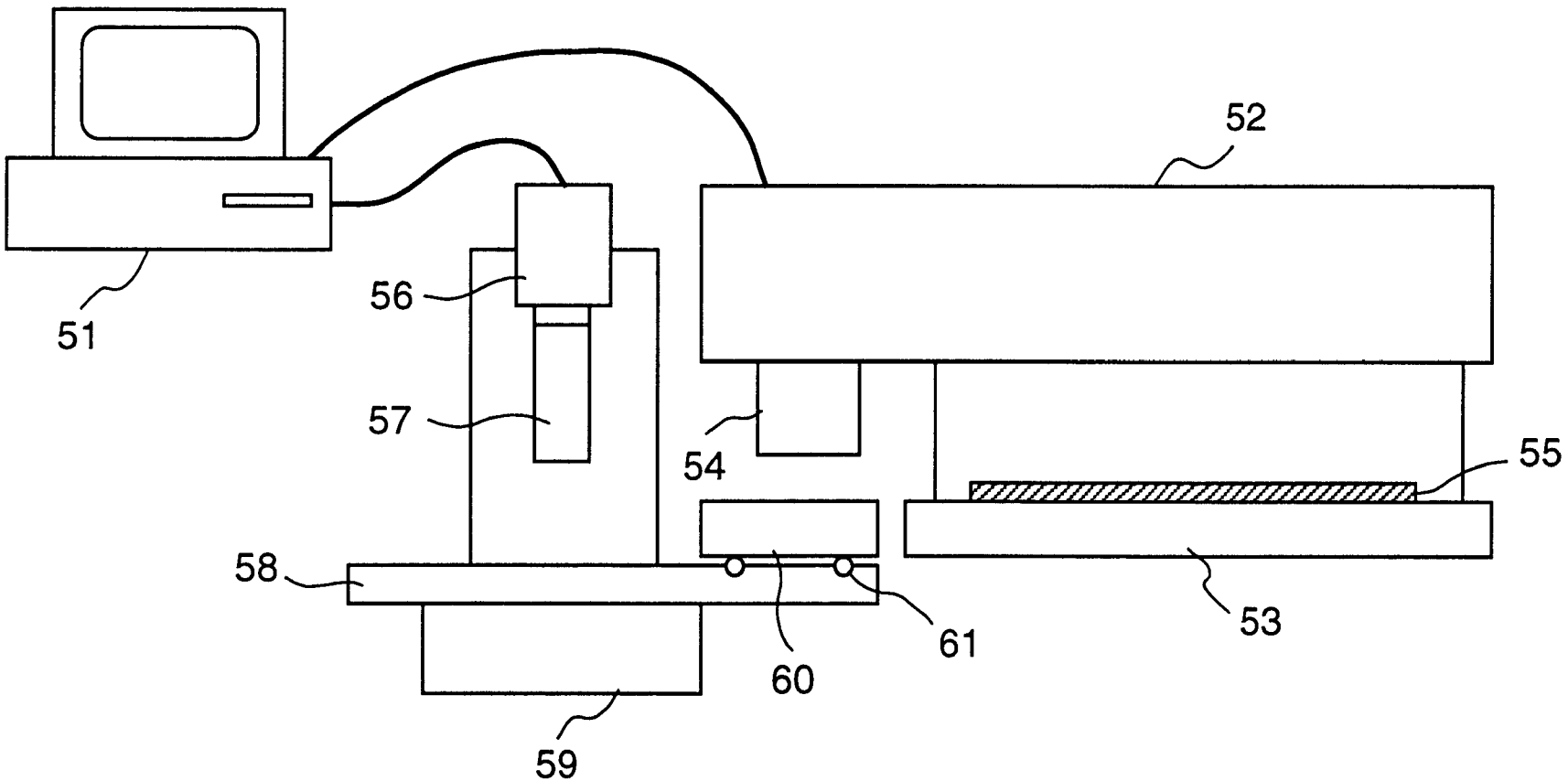
FIG. 5 shows a printing apparatus incorporating an apparatus for measuring an amount of ink discharged.

FIG. 5 is a printing apparatus which contains the apparatus for measuring the amount of ink discharged as described above. In FIG. 5, reference numeral 51 denotes a personal computer (referred as "PC", hereinafter), having image processing function, for controlling the printing apparatus and the apparatus of measuring the amount of ink discharged; 52, a printer main body; 53, a printer stage where a printing medium is set; and 54, an ink-jet type printhead which prints as moving left-to-right in this embodiment. Further, reference numeral 55 denotes a printing medium, such as a paper sheet; 56, a CCD camera; 57, a microscope for magnifying a printed dot; 58, a stage of the microscope 57 (has a hole in the central part so that it can utilize a light source); 59, a light source; 60, a transparent plate, such as a glass plate; and 61, a roller used for moving the transparent plate 60 on the stage 58 of the microscope 57.

In the aforesaid apparatus, the printhead 54 prints on the printing medium 55 as it moves back and forth in the right and left direction. After the printhead 54 has printed for a predetermined time period or the predetermined number of lines, it moves to the transparent plate 60 where it prints dots by using the nozzles currently being used for printing. The transparent plate 60 moves under the microscope 57, and the densities of the dots printed on the transparent plate 60 are measured in accordance with the aforesaid method by using the light source 59 and the CCD camera 56. Next, the PC 51 instantly converts each measured density into the amount of ink discharged by referring to the calibration line obtained in advance. If the amount of ink discharged is outside of a predetermined range, for example, a pulsewidth, or the like, to be applied to the nozzle of the printhead is changed so as to properly control an amount of ink discharged from the nozzle.

In this case, it is not necessary for the printer to suspend the printing operation after the printhead 54 has printed dots on the transparent plate 60 until the amount of ink discharged is calculated, i.e., the calculation of the amount of ink discharged and the printing operation can be carried on in parallel.

Further, by developing a print pattern of several lines on an image memory of the apparatus, the PC 51 can predict which nozzle is used continuously for how long time. The PC 51 decides a timing to measure amount of ink discharged in accordance with the prediction. Therefore, there would be a case where amount of ink discharged is not measured at all during a printing operation, depending on a printing pattern.

This series of control can be arbitrary changed by changing a control program stored in the PC 51.

A configuration of an ink-jet head and a method of controlling the amount of ink discharged in the ink-jet head will be explained below.

Figure 6:
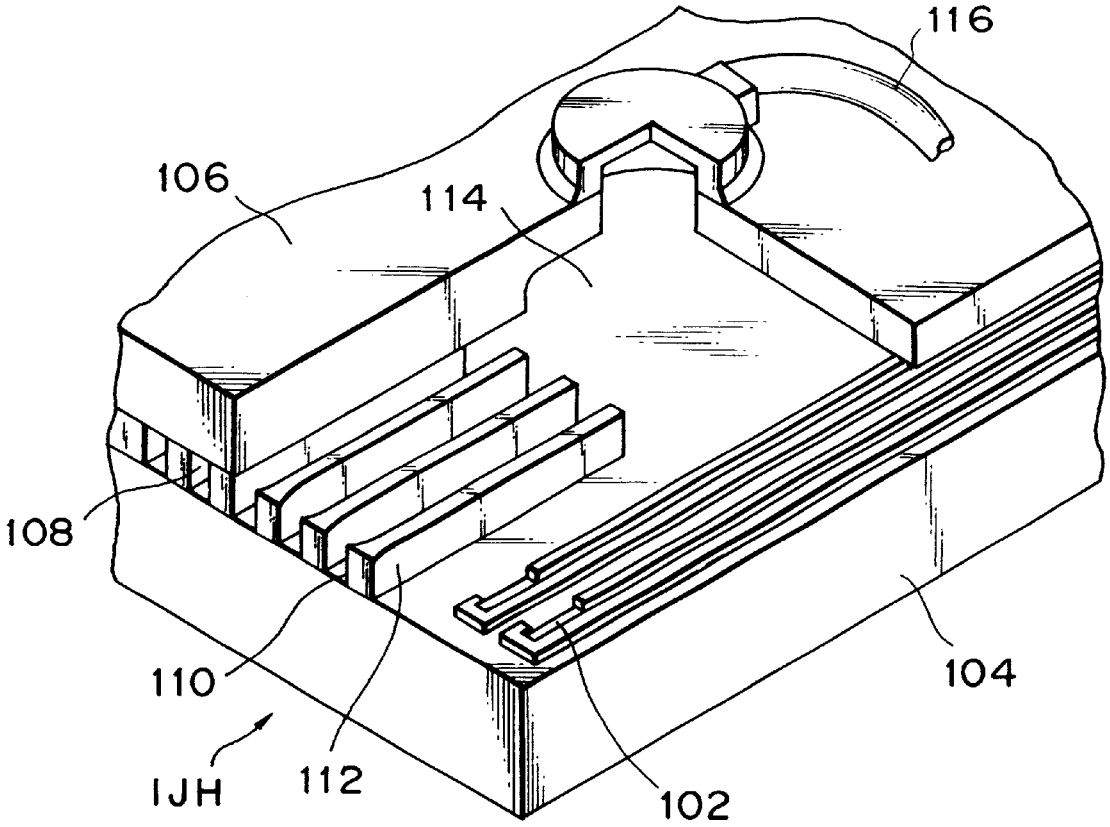
FIG. 6 illustrates a configuration of an ink-jet head.

FIG. 6 shows a configuration of an ink-jet head IJH.

Referring to FIG. 6, the ink-jet head IJH mainly comprises a heater board 104 as a board on which a plurality of heaters 102 for heating an ink are formed, and a ceiling plate 106 mounted on the heater board 104. A plurality of discharging openings 108 are formed in the ceiling plate 106. Tunnel-like fluid passages 110 communicating with the discharging openings 108 are formed therebehind. The respective fluid passages 110 are isolated from the adjacent fluid passages by partition walls 112. The respective fluid passages 110 are commonly connected to one ink chamber 114 at the rear end of the fluid passages. An ink is supplied to the ink chamber 114 via an ink inlet 116, then supplied from the ink chamber 114 to each fluid passage 110.

Figure 7:
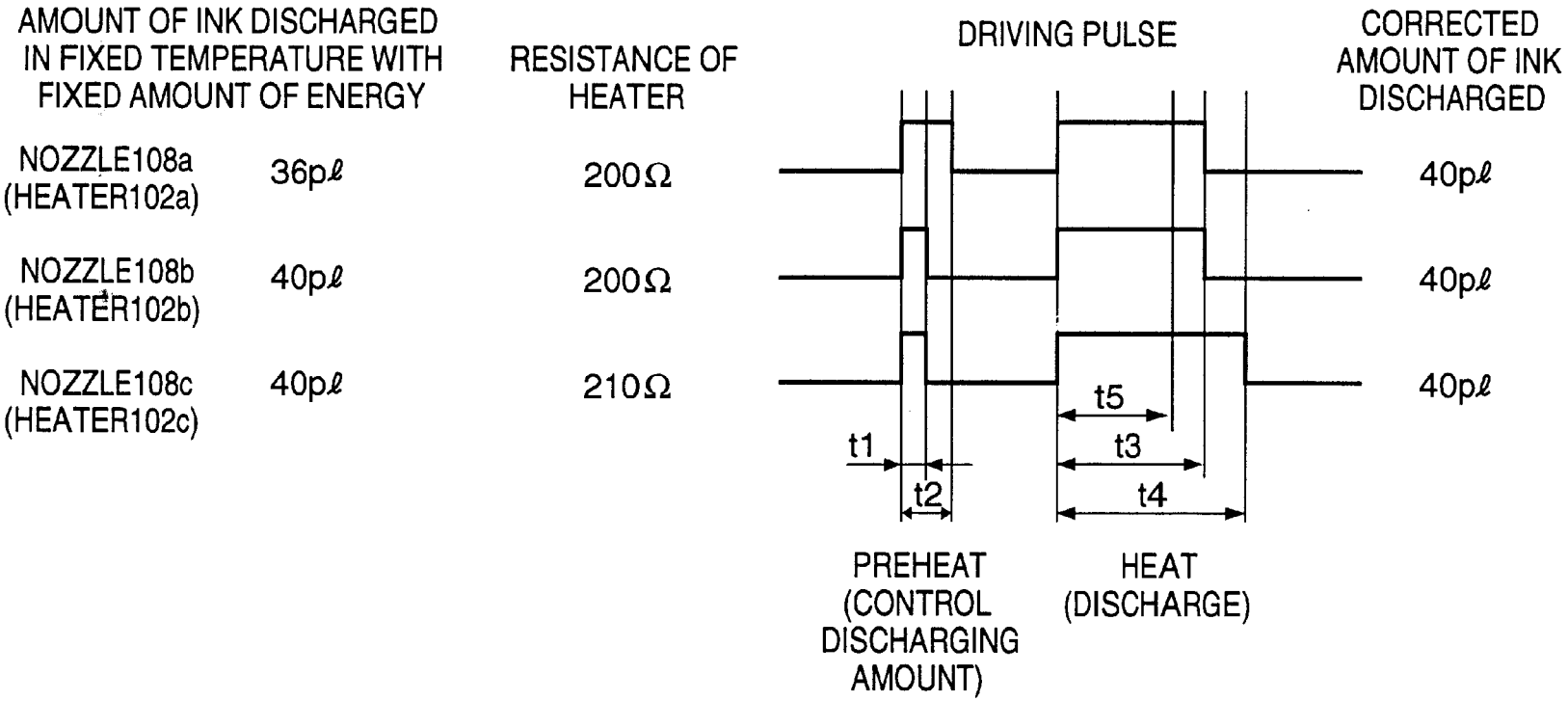
FIG. 7 is an explanatory view showing a method of controlling an amount of ink to be discharged by changing pulsewidths to be applied to a heater.

The heater board 104 and the ceiling plate 106 are positioned such that the position of each heater 102 coincides with that of a corresponding fluid passage 110, and are assembled into the state shown in FIG. 7. Although FIG. 6 shows only two heaters 102, the heater 102 is actually arranged in correspondence with each fluid passage 110. When a predetermined driving pulse is supplied to the heater 102 in the assembled state shown in FIG. 6, an ink above the heater 102 is led to film boiling and a bubble is produced, and the ink is pushed and discharged from the discharging opening 108 upon volume expansion of the bubble. Therefore, the size of a bubble can be adjusted by controlling a driving pulse applied to the heater 102, e.g., controlling the magnitude of electric power. That is, the volume of the ink discharged from each discharging opening can be controlled as desired.

FIG. 7 is a timing chart for explaining a method of controlling the amount of ink discharged by changing electric power supplied to each heater in the aforesaid manner.

In this embodiment, two types of constant-voltage pulses are applied to each heater 102 to adjust the amount of ink discharged. The two pulses are a preheat pulse and a main heat pulse (to be simply referred to as a heat pulse hereinafter) as shown in FIG. 7. The preheat pulse is a pulse for heating the ink to a predetermined temperature before the ink is actually discharged. The pulsewidth of this pulse is set to be smaller than a minimum pulsewidth t5 required to discharge the ink. Therefore, the ink is not discharged by this preheat pulse. The preheat pulse is applied to each heater 102 to increase the initial temperature of the ink to a predetermined temperature in advance so as to always make the amount of ink discharged constant when a constant heat pulse is applied to the heater 102 afterward. In contrast to this, the temperature of the ink may be adjusted in advance by adjusting the width of a preheat pulse. In this case, for the same heat pulse, the amount of ink discharged can be changed. In addition, by heating an ink before application of a heat pulse, the preparation time required to discharge the ink upon application of the heat pulse can be shortened, which improves the responsiveness of the printhead to the heat pulse.

The heat pulse is a pulse for actually discharging the ink. The pulsewidth of the heat pulse is set to be larger than the minimum pulsewidth t5 required to discharge the ink. Energy generated by each heater 102 is proportional to the width (application time) of a heat pulse. Therefore, variations in the characteristics of the heaters 102 can be adjusted by adjusting the width of each heat pulse.

Note that the amount of ink discharged can be also adjusted by adjusting the interval between a preheat pulse and a heat pulse to control the dispersing state of heat upon application of the preheat pulse.

As is apparent from the above description, the amount of ink discharged can be controlled both by adjusting the application time of a preheat pulse or a heat pulse and by adjusting the interval between application of a preheat pulse and that of a heat pulse. Therefore, by adjusting the application time of a preheat pulse and a heat pulse or the interval between application of a preheat pulse and that of a heat pulse as needed, the amount of ink discharged or the responsiveness of the printhead discharging the ink to an applied pulse can be adjusted as desired.

Such adjustment of the amount of ink discharged will be described in detail next.

Assume that the ink is discharged in different amounts from the discharging openings (nozzles) 108*a,* 108*b,* and 108*c* upon application of the same energy, as shown in FIG. 7. More specifically, assume that when predetermined energy is applied at a predetermined temperature, the amount of ink discharged from the nozzle 108*a* is 36 pl (pico-liters); the amount of ink discharged from the nozzle 108*b,* 40 pl; and the amount of ink discharged from the nozzle 108*c,* 40 pl, and the resistance of heaters 102*a* and 102*b* respectively corresponding to the nozzles 108*a* and 108*b* is 200 Ω, and the resistance of a heater 102*c* corresponding to the nozzle 108*c* is 210 Ω. Further, assume that the amounts of ink discharged from the nozzles 108*a,* 108*b,* and 108*c* are to be adjusted to 40 pl.

The widths of a preheat pulse and a heat pulse may be adjusted to adjust the amounts of ink discharged from the nozzles 108*a,* 108*b,* and 108*c* to the same amount. Various combinations of the widths of preheat pulses and heat pulses are conceivable. In this embodiment, the amounts of energy generated by heat pulses are made equal for the three nozzles, and the amounts of ink discharged are adjusted by adjusting the widths of preheat pulses.

Since the heaters 102*a* and 102*b* for the nozzles 108*a* and 108*b* have the same resistance, i.e., 200 Ω, the amounts of energy generated by heat pulses can be made equal by applying voltage pulses having the same width to the heaters 102*a* and 102*b*. In this embodiment, the width of each voltage pulse is set to be t3 which is longer than the width t5. However, the ink is discharged in different amounts, i.e., 36 pl and 40 pl, from the nozzles 108*a* and 108*b* upon application of identical energy. In order to increase the amount of ink discharged from the nozzle 108*a,* a preheat pulse having a width t2 longer than a width t1 of a preheat pulse applied to the heater 102*b* is applied to the heater 102*a*. With this operation, the amounts of ink discharged from the heaters 108*a* and 108*b* can be adjusted to 40 pl.

The heater 102*c* for the nozzle 108*c* has a resistance of 210 Ω, which is higher than the resistance of the two other heaters 102*a* and 102*b*. For this reason, in order to cause the heater 102*c* to generate the same amount of energy as that generated by the two other heaters, the width of a heat pulse must be set to be longer than that of the above heat pulse. In this embodiment, therefore, the width of the heat pulse is set to be t4 which is longer than the width t3. Since the amounts of ink discharged from the nozzles 108*b* and 108*c* upon application of the same amount of energy are the same, the width of a preheat pulse required is equal to that of a preheat pulse applied to the heater 102*b*. That is, a preheat pulse having the width t1 is applied to the heater 102*c*.

In the above manner, the same amount of ink can be discharged from the nozzles 108*a,* 108*b,* and 108*c* which discharge an ink in different amounts upon application of a predetermined energy to corresponding heaters having different resistance from each other. In addition, the amounts of ink discharged may be intentionally made different from each other. Note that preheat pulses are used to reduce variations in the amount of ink discharged from each nozzle.

Next, two typical method for reducing unevenness in printing by an ink-jet head will be described.

Figure 8:
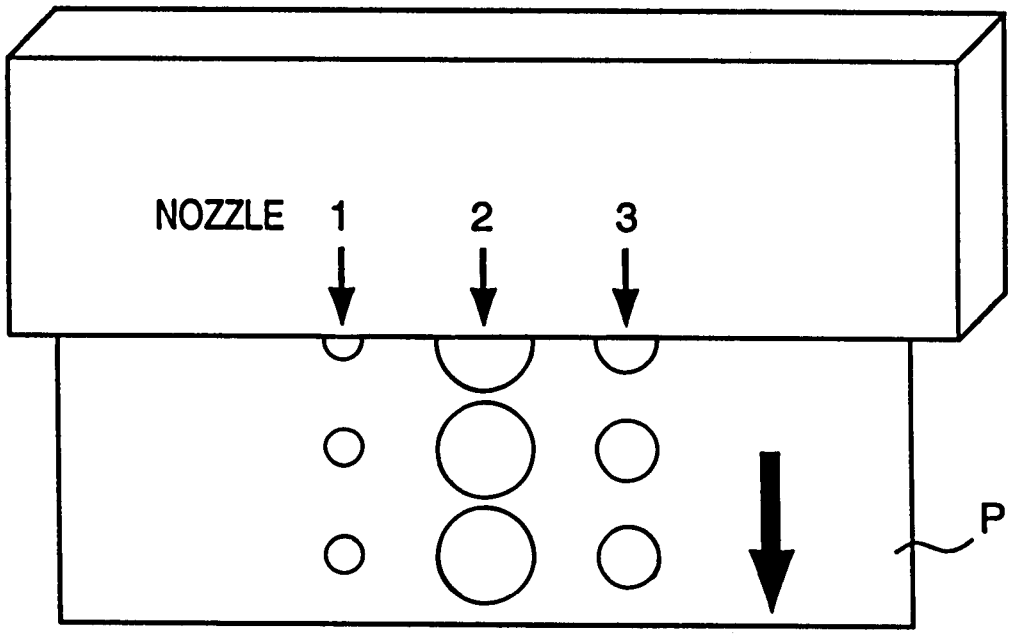
FIG. 8 is an explanatory view showing a method of correcting differences in amount of ink discharged from each nozzles.
Figure 9:
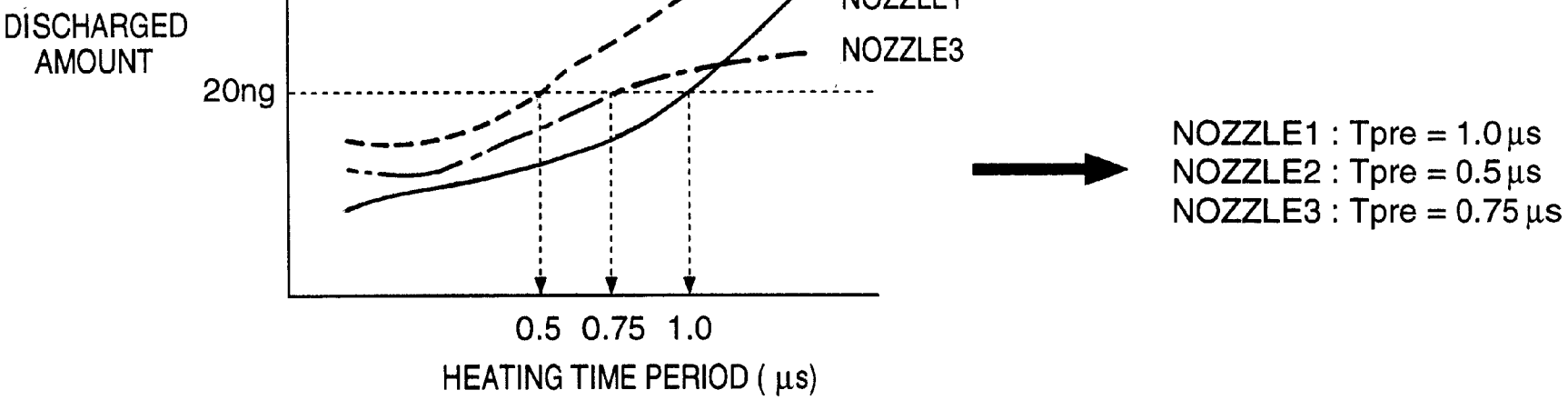
FIG. 9 is a graph showing the method of correcting differences in amount of ink discharged from each nozzles.
Figure 10:
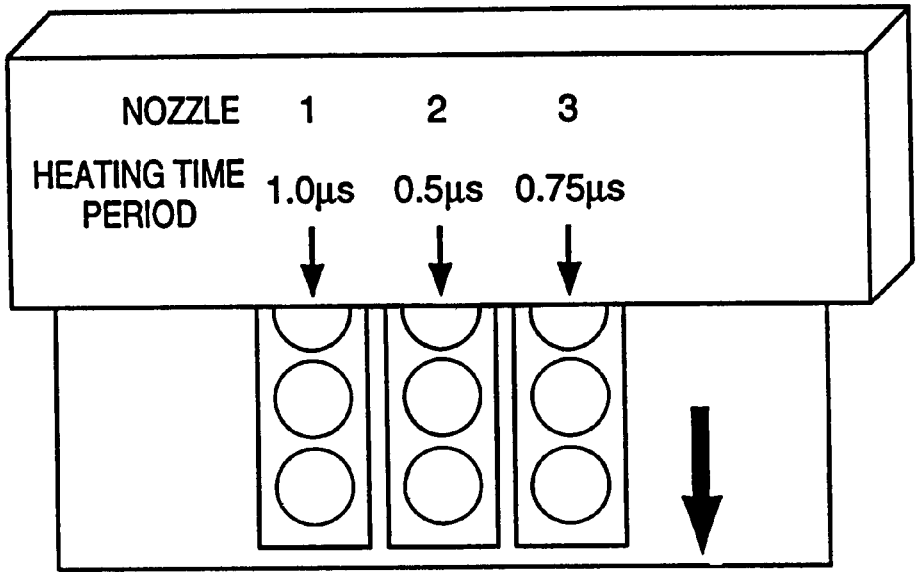
FIG. 10 is an explanatory view showing the method of correcting differences in amount of ink discharged from each nozzles.

FIGS. 8 to 10 show a method of correcting differences between amounts of ink discharged from a plurality of nozzles of the ink-jet head IJH (called "bit correction", hereinafter).

First, as shown in FIG. 8, three nozzles, a nozzle 1, a nozzle 2 and a nozzle 3, for example, of the ink-jet head IJH is made discharge ink onto a predetermined plate P. Then, the sizes of ink dots made of the ink discharged from respective nozzles 1, 2 and 3 on the plate P are measured, and the amount of ink discharged from each nozzle is found. Upon measuring the amount of ink discharged, heat pulses (refer to FIG. 7) to be applied to heaters of the nozzles are first set to a fixed pulsewidth, and the preheat pulsewidths (refer to FIG. 7) are changed as already described above. As a result, as shown in FIG. 9, curves showing relationship between preheat pulsewidths (referred as "heating time period" in FIG. 9) and the amounts of ink discharged are obtained. If it is desired to fix the amount of ink to be discharged from each nozzle to 20 ng, then it can be found from the graph shown in FIG. 9 that the pulsewidth to be applied to the nozzle 1 is 1.0 ms, to the nozzle 2, 0.5 ms, and to the nozzle 3, 0.75 ms. Therefore, by applying the preheat pulses having above pulsewidths to the heaters of the nozzles, it is possible to adjust the amount of ink discharged from each nozzle to a fixed amount of 20 ng. To correct the amount of ink discharged from each nozzle as described above is called bit correction. In this embodiment, the pulsewidth of the preheat pulse is changed in four stages, which achieves correction range of the amount of ink discharged by about 30% of the amount. Further, the resolution of the correction is between 2% and 3%.

Figure 11:
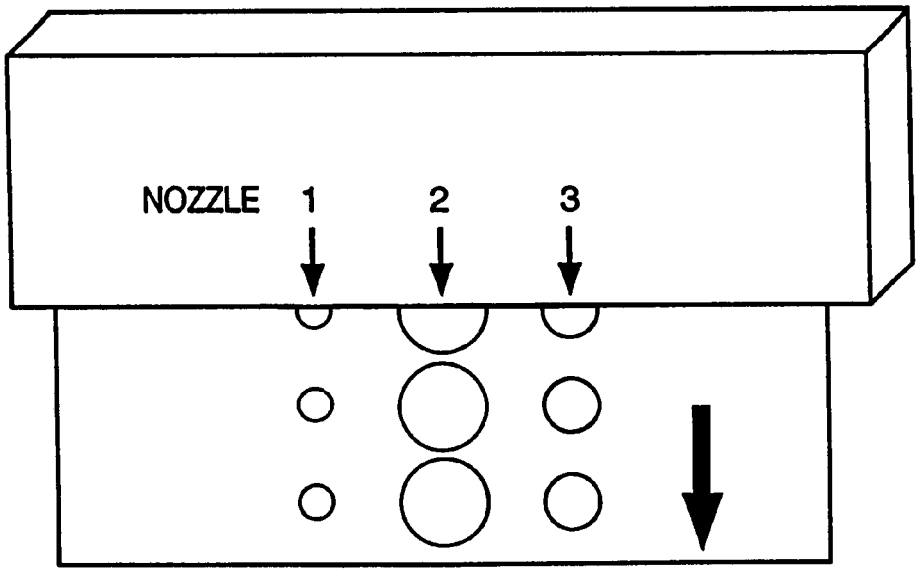
FIG. 11 is an explanatory view showing the method of changing printing densities.
Figure 12:
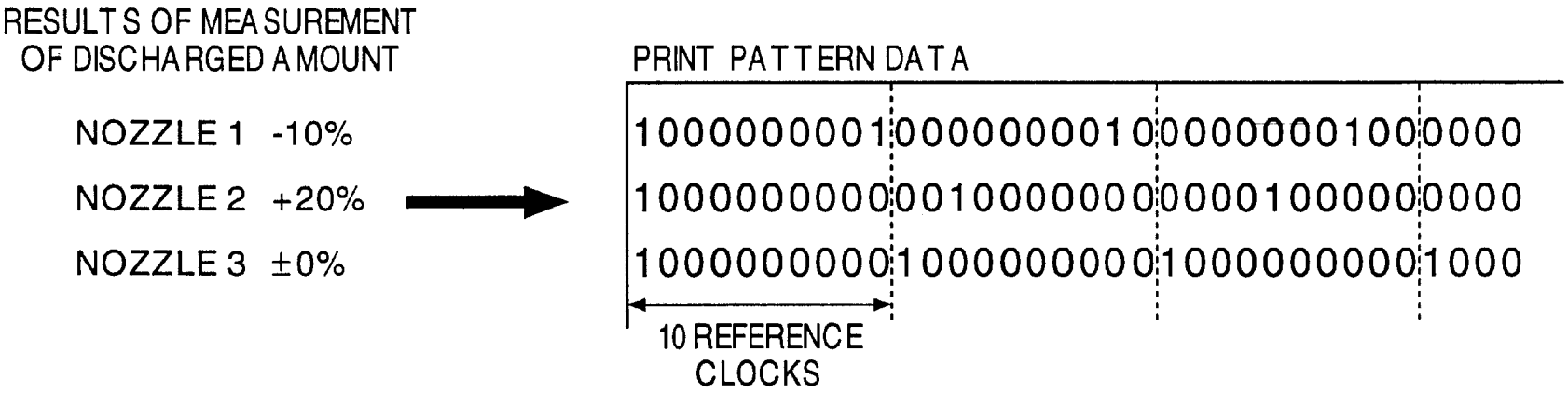
FIG. 12 is an explanatory view showing the method of changing printing densities.
Figure 13:
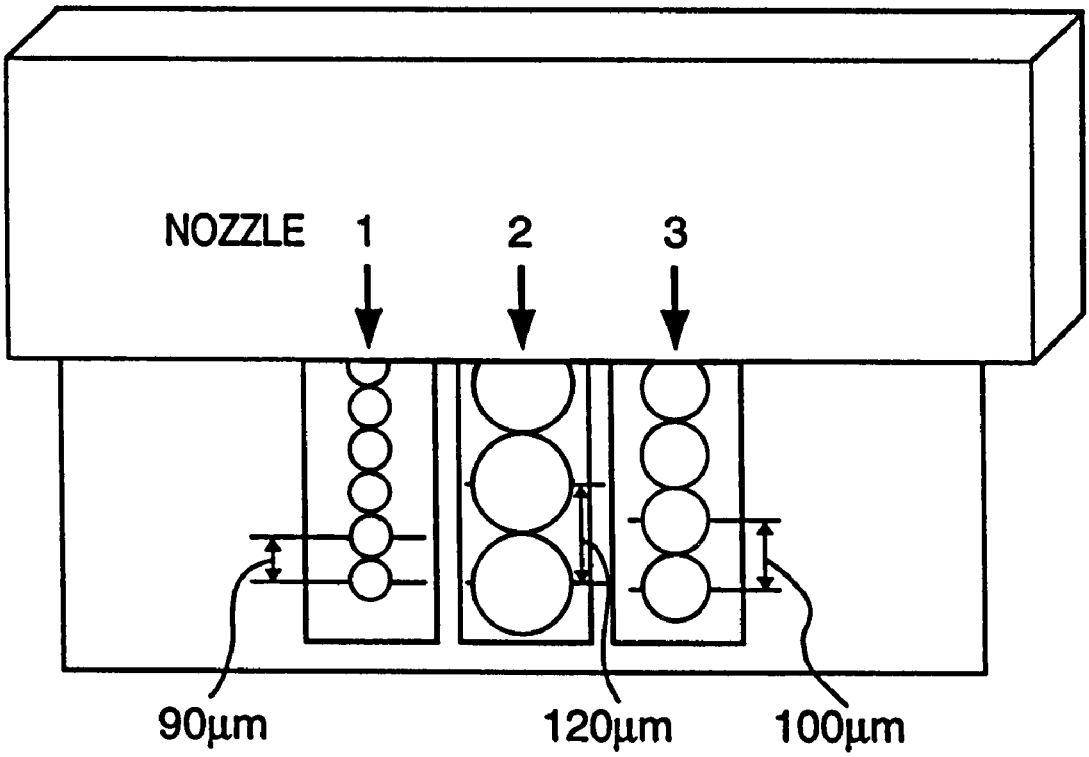
FIG. 13 is an explanatory view showing the method of changing printing densities.

Next, FIGS. 11 to 13 show a method of correcting unevenness in printing in the scanning direction of the ink-jet head (called "shading correction", hereinafter) by adjusting density of dots (i.e., the number of dots printed in a unit area) printed by ink-discharging nozzles.

As shown in FIG. 11, for example, when the amount of ink discharged from the nozzle 3 of the ink-jet head is defined as reference, assume that the amount of ink discharged from the nozzle 1 is about 10% less then the reference, and the amount of ink discharged from the nozzle 2 is about 20% more than the reference. Under this condition, while the ink-jet head IJH scans, the heater of the nozzle 1 is applied with heat pulses once every nine reference clocks, the heater of the nozzle 2 is applied with heat pulses once every 12 reference clocks, and the heater of the nozzle 3 is applied with heat pulses once every 10 reference clocks as shown in FIG. 12. Thus, the number of discharging operations in the scanning direction can be adjusted for each nozzle, thereby it is possible to set density of printed ink dots in the scanning direction to a uniform density, thus preventing unevenness in printing. To correct density of printed ink dots in the scanning direction as described above is called "shading correction". In this embodiment, this correction achieves correction range of the density of ink discharged by about 30% of the density. Further, it is possible to control the distance between each dots to be infinitely short (i.e., to increase resolution) theoretically. However, if doing so, the amount of data greatly increases, which makes the processing speed slower. Therefore, about 10% increase in resolution is the substantial limitation.

Upon measuring the amount of ink discharged by using the measuring apparatus according to the first embodiment and actually performing printing operation by a printing apparatus in accordance with the measured results, it is possible to correct unevenness in density, caused by difference in the amount of ink discharged from each nozzle, by properly adjusting the amount of ink discharged by using a method of the changing pulsewidth of a preheat pulse or a method of changing density of printed dots.

(Second Embodiment)

In the first embodiment, the light source which emits white light is used. In a case where density of a dot of blue (B) ink is to be measured, a proper band-pass filter which transmits light in red (R) wavelength range is placed between the light source and the dot, then absorbance of a dot is measured from the light transmitted through the band-pass filter and the dot (light in red wavelength range). Upon measuring the absorbance, it is necessary to optimize the intensity of light from the light source and the bandwidth of the filter, needless to say. In addition to these optimizations, to increase the tones of luminance levels (256 tones in the first embodiment) may further increases accuracy of measured data.

(Third Embodiment)

The image processing unit is used to measure the density of a dot in the aforesaid first and second embodiments, however, the present invention is not limited to this. For example, transmitted light may be received by PMT (Photoelectron Magnification Tube), then the output from the PMT may be analog-digital converted into a signal in luminance level. At this time, by using an A/D converter having higher resolution, better measurement accuracy can be achieved as mentioned in the second embodiment.

Further, luminance level (quantity of light) of the transmitted light is found as a density in the above embodiments, however, the present invention is not limited to the transmitted light, and reflected light received can be used instead.

(Fourth Embodiment)

Figure 14:
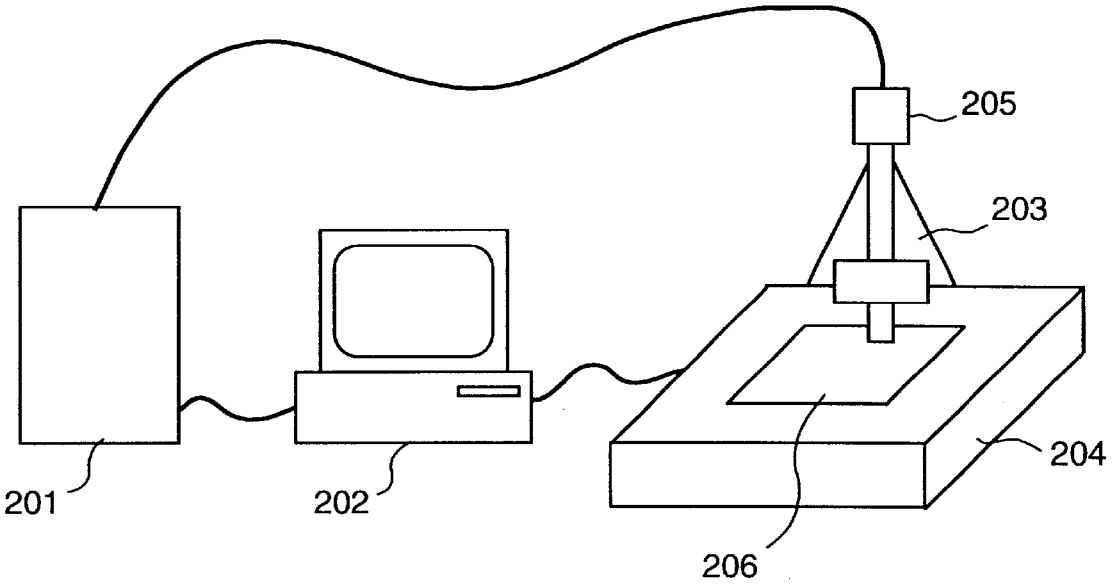
FIG. 14 shows a configuration of an apparatus for measuring an amount of ink discharged according to the fourth embodiment of the present invention.

FIG. 14 depicts a configuration of a measuring apparatus according to a fourth embodiment of the present invention. In FIG. 14, reference numeral 201 denotes an image processing unit for measuring density; 202, a personal computer (referred as "PC", hereinafter) used to control the image processing unit 201 and an X control stage 204; 203, an optical system for magnifying an image; 204, the X control stage used when densities of an object subjected to measurement are measured continuously; 205, a line sensor camera for inputting an image of the object subjected to measurement into the image processing unit 201; and 206, a light source set under the X control stage 204. The central part of the surface of the X control stage 204 is made of glass so that an image of the object to be measured can be inputted by the line sensor camera 205 by utilizing light from the light source 206. The PC 202 controls the X control stage 204 via RS232C or GPIB interface as well as controls the image processing unit 201.

Figure 15:
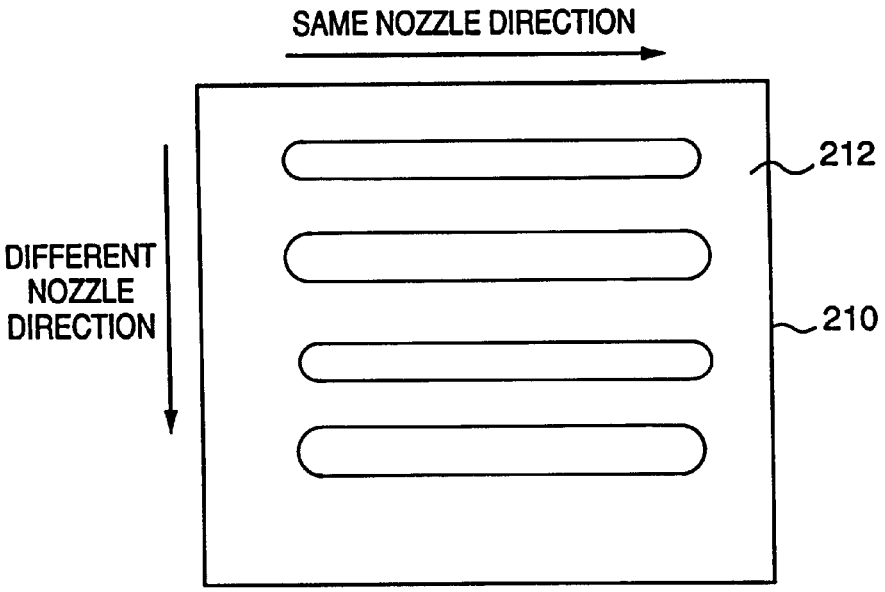
FIG. 15 illustrates an example of a line pattern printed by using an ink-jet printer.

FIG. 15 shows a line pattern formed by discharging ink from a plurality of different nozzles of an ink-jet printer onto a transparent glass plate 210. Further, "same nozzle direction" in FIG. 15 indicates the direction of ink lines discharged from an identical nozzle, and "different nozzle direction" indicates the direction of ink discharged from a plurality of different nozzles. It should be noted that, since ink and glass are incompatible with each other, a special process for mediating between the discharged ink and the glass plate 210 is to be necessarily applied on the glass plate 210 (the glass plate is coated with polyvinyl alcohol to form an ink-absorbent layer 212 in this example). With this process, ink discharged from each nozzle is uniformly absorbed by the ink-absorbent layer 212 and forms the line pattern as shown in FIG. 15. As for the material of the ink-absorbent layer 212, a material which is as transparent and colorless as possible (i.e., which do not absorb light) is preferred.

The optical system 203 focuses on an arbitrary line of the line pattern as shown in FIG. 15 and the magnification of the optical system 203 and the intensity of light from the light source 206 are properly adjusted. Under this condition, an image of the focused image is inputted by the line sensor camera 205 into the image processing unit 201. In the fourth embodiment, the magnification is 5, however, the present invention is not limited to this.

The line sensor camera 205 in this embodiment is a black-and-white line sensor. An image inputted by this line sensor camera 205 consists of a collection of minimal pixel units that the image processing unit 201 can resolve, and each minimal pixel can represent luminance level in 256 tones, between 0 and 255 tones, in accordance with the intensity of the transmitted light.

Next, a method of measuring the density of a line of the line pattern will be described.

In this embodiment, the density of a line of the line pattern is determined by how much the incidented light (white light) is absorbed while transmitting a line with color (density) which is subjected to measurement. More specifically, the higher the density of a line subjected to measurement is, the more the light is absorbed, and the intensity of transmitted light is decreased. Therefore, the luminance level of the minimal pixel in an area of the line subjected to measurement must be low. Contrarily, if the density of the line is low, then the luminance level of the minimal pixel must be high. This embodiment focuses on this fact, and the density is replaced by a light absorbance (although what the image processing unit 1 actually measure is a luminance level). The fourth embodiment is the same as the first embodiment in this point.

Figure 16:
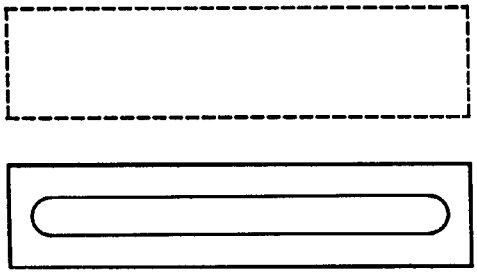
FIG. 16 shows an example when a line subjected to measurement is marked by a window.

Then, an image of a line subjected to measurement inputted as described above by using the line sensor camera is enclosed by a fixed sized frame (called "window", hereinafter) as shown in FIG. 16. Basically, it is preferred to sum up all of the luminance levels of the minimal pixels of a line subjected to measurement to measure its density, however, when the line is actually observed through the microscope, it is very difficult to determine the border between the line and the background since the density in the edge part of the line is low. Therefore, a window whose size is large enough to include the entire line subjected to measurement (including its surrounding) is used to specify an area, then all the luminance levels of the minimal pixels in the window are summed up. The obtained sum is considered as a total luminance of the line subjected to measurement.

The window size can be arbitrarily determined in consideration with the size of the line subjected to measurement. However, if the window size is set too large, the luminance level in too large background area which is essentially nothing to do with the line density is included, which degrades accuracy of the measured data. Therefore, too large window size is not preferable.

Prior to finding the total luminance of the line shown in FIG. 16, the part which does not include the line pattern (i.e., the part where only the ink-absorbent layer 12 exists) is first marked by the window of the same size (shown in doted line), and the total luminance inside of the window is found. This total luminance is defined as a reference total luminance which indicates a state in that light absorbance is the minimum (i.e., minimum density). Then, the actually measured total luminance of the line subjected to measurement is divided by the reference total luminance, then the common logarithm of the reciprocal of the quotient is defined as the absorbance (density data) of the line subjected to measurement.

Namely,

Absorbance (density data)

=Log((reference total luminance)

÷(total luminance))

Figure 17:
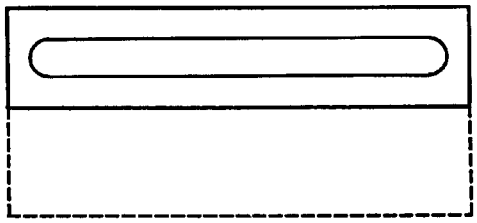
FIG. 17 shows another example when a line subjected to measurement is marked by a window.

FIG. 17 shows a case where the reference total luminance is found near the line pattern. According to experiments conducted by the applicants of the present invention, better result was obtained when the reference total luminance was calculated near the line pattern as shown in FIG. 17 than the reference total luminance was calculated in the area apart from the line patterns by some distance. The reason for this would be effect of the spatial distribution of the quantity of light from the light source.

Thereafter, remaining lines of the line pattern are marked by a window of the same size in sequence, and absorbances (density data) of the lines can be obtained in the same manner as described above.

Then, by controlling the X control stage 204 by using the PC 202, the line pattern can be continuously inputted. Thereafter, each line of the line pattern is marked with the window after inputting the line pattern, absorbances of all the lines of the line pattern can be found. With a calibration line obtained in advance (a method of measuring the calibration line is the same as that in the first embodiment), it is easy to convert the density of each line of the line pattern into an amount of ink discharged in a single discharging operation by using the PC 202.

Note that assuming that the line pattern is formed by ink discharged for fifty times, the density of the line pattern obtained above is the sum of density of ink dots corresponding to the fifty times of ink discharged. Therefore, to find an amount of ink discharged by single discharging operation based on the calibration line, the density of the line pattern is divided by the number of times of ink discharged to form the line pattern.

Next, it will be shown that a method of finding the amount of ink discharged in a single discharging operation based on the density of a line of the line pattern (line pattern density method) can be used instead of a method of finding an amount of ink discharged in a single discharging operation based on the density of an ink dot (dot density method), which is described in the first embodiment.

Figure 18:
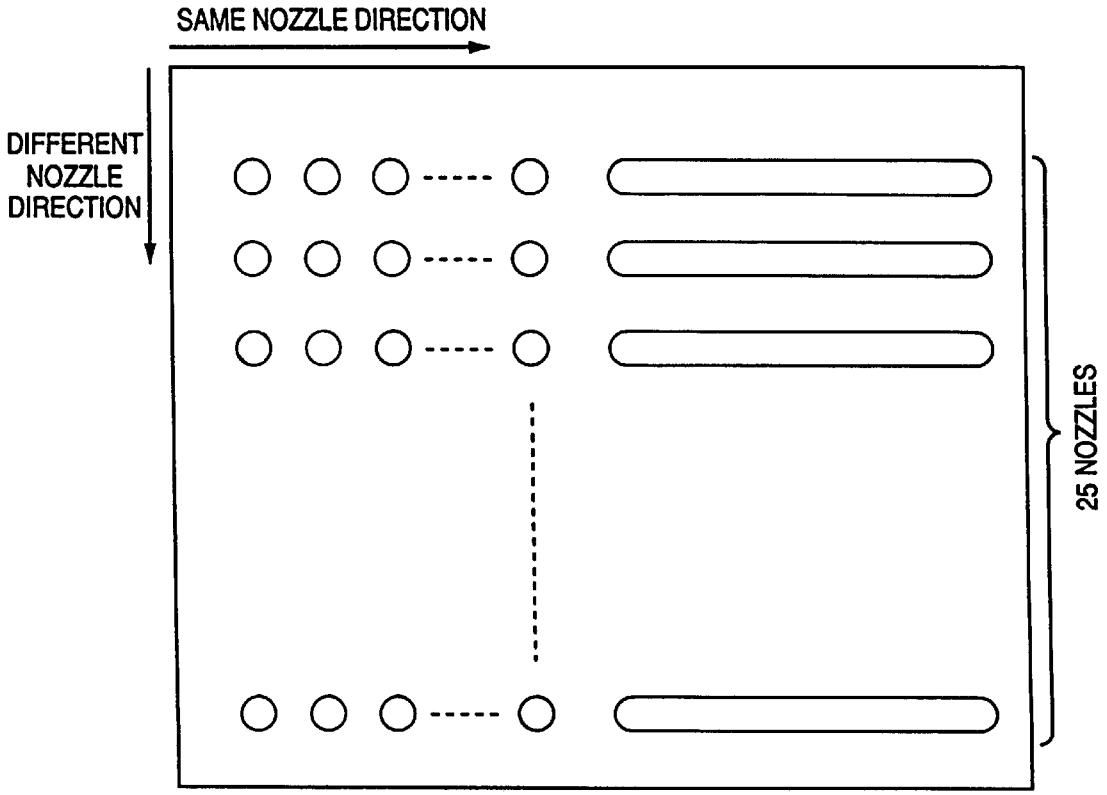
FIG. 18 illustrates an ink-discharge patterns for comparison between a dot density method and a line pattern density method.

FIG. 18 shows an ink-discharging pattern used in the measurement. Twelve dots are printed by using an identical nozzle, then a line is printed. Each line of the formed line pattern by a plurality of nozzles is formed with 50 dots. The densities of the dots are measured by using the dot density method, and the densities of the lines are measured by using the line pattern density method. Thereafter, the obtained data in absorbance is compared. The average of the densities of the 12 dots is taken as data in the dot density method. The comparison result is shown in FIG. 19.

Figure 19:
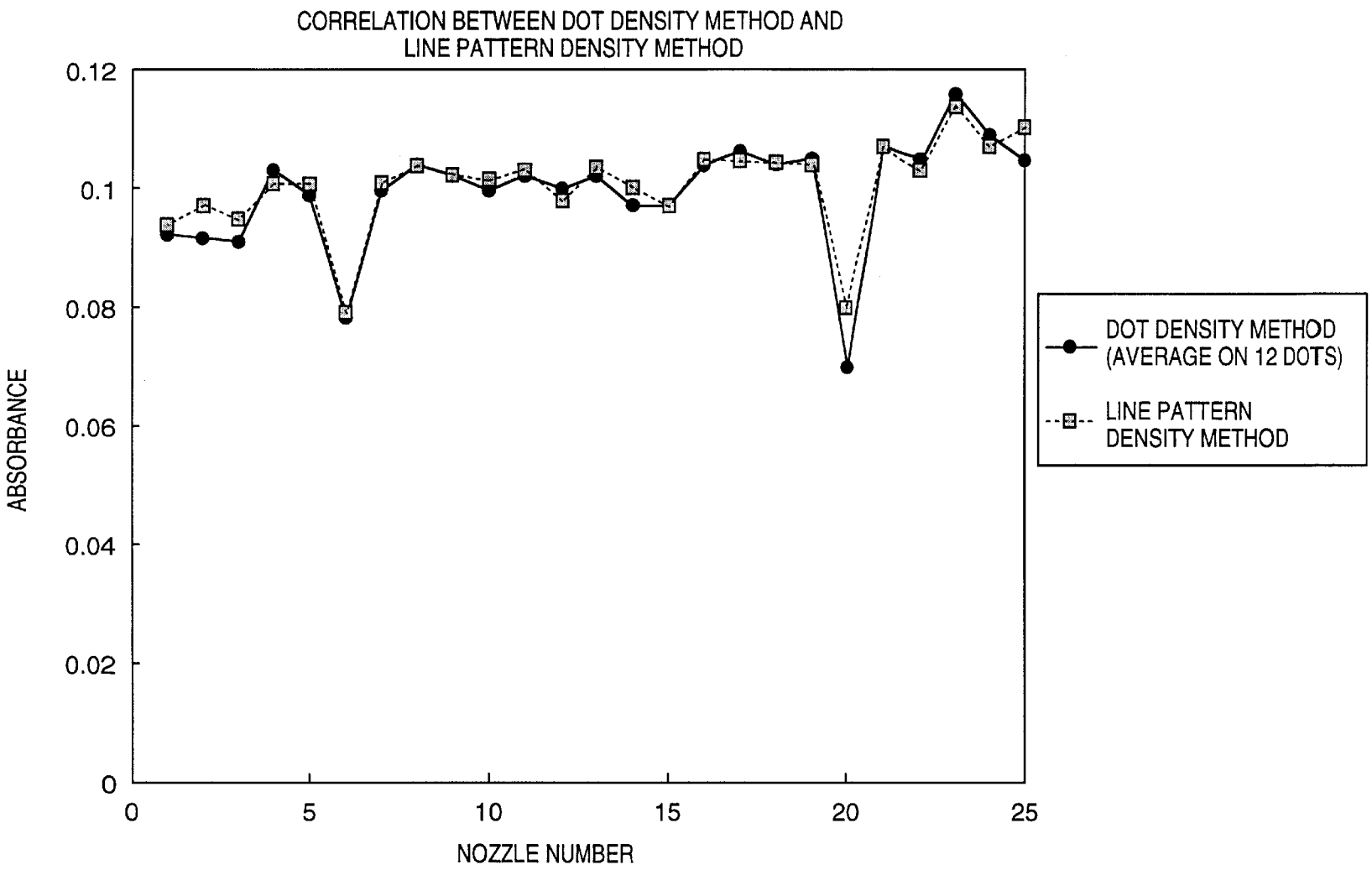
FIG. 19 is a graph showing the measured results based on the dot density method and the line pattern density method.

As seen in FIG. 19, it can be concluded that the line pattern density method according to the fourth embodiment is worth replacing the dot density method.

Further, in the dot density method, since a plurality of dots are measured for finding an average amount of ink discharged, it takes some time to find the average amount. In contrast, a line of the line pattern is measured in single measuring operation according to the fourth embodiment, thus there is a merit that measuring time can be shortened.

After an amount of ink discharged in a single discharging operation is measured as described above, the obtained result is fed back to the printing apparatus so that printing on a printing medium is performed without unevenness in density of each ink dot by adjusting an amount of ink to be discharged by using an adjusting method as described in the first embodiment.

(Fifth Embodiment)

In the fourth embodiment, the line sensor camera is used for inputting an image of the line pattern, however, a CCD camera, or other area sensors can be used instead. Further, by increasing the number of luminance levels used in the image processing operation (256 tones are used in the fourth embodiment), accuracy of the measured data can be further increased.

(Sixth Embodiment)

Figure 20:
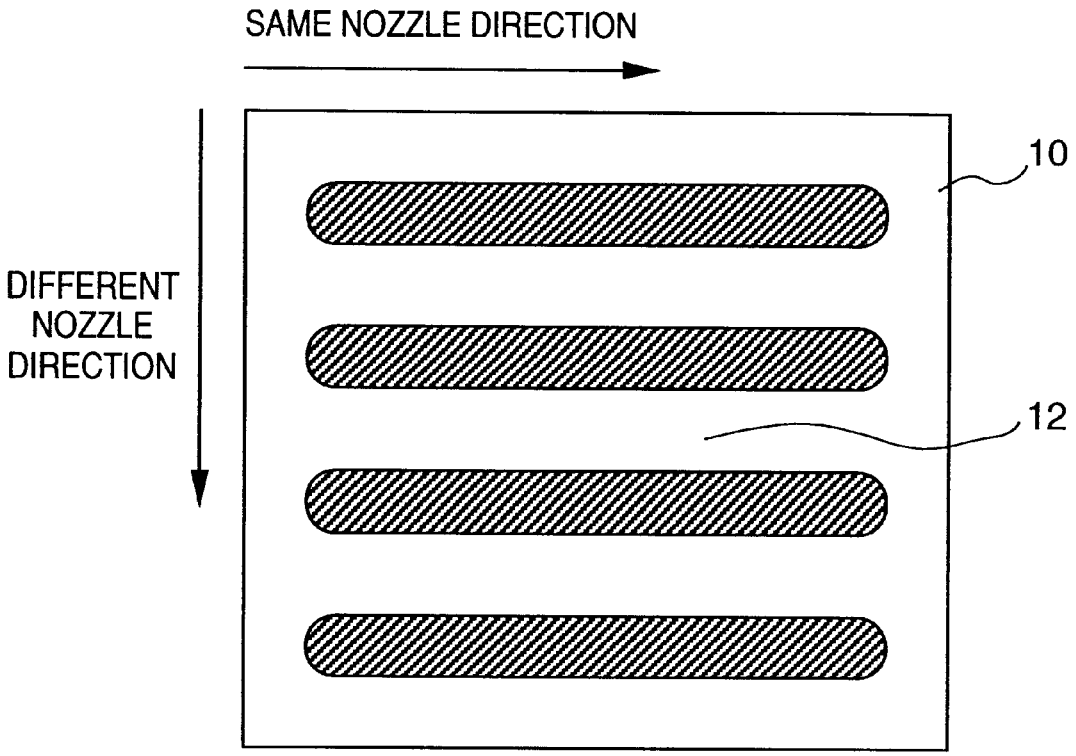
FIG. 20. shows an example of a line pattern printed by using an ink-jet printer.

FIG. 20 is an example of a line pattern printed on a glass plate 10 by a plurality of different nozzles of an ink-jet printer. The "same nozzle direction" in FIG. 20 indicates the direction of prints of ink dots discharged from the same nozzle, and the "different nozzle direction" in FIG. 20 indicates the direction of prints of ink dots discharged from a plurality of different nozzles in a single discharging operation. Since ink and glass are incompatible with each other, a special process for mediating between the discharged ink and the glass plate 10 needs to be applied on the glass plate 10 (the glass plate is coated with polyvinyl alcohol to form an ink-absorbent layer 12 in this example). By virtue of this process, ink discharged from each nozzle during single discharging operation is uniformly absorbed by the ink-absorbent layer and forms a line pattern such as that shown in FIG. 20. As for the material of the ink-absorbent layer 12, a material which is as transparent and colorless as possible (i.e., which does not absorb light) is preferred.

Under the condition where the optical system 203 (FIG. 14) focuses on the printed line pattern as shown in FIG. 20 and the magnification of the optical system 203 and the intensity of the light source 206 are properly adjusted, an image thereof is inputted in the image processing unit 201 via the line sensor camera 205. Although the magnification ratio is five in the present embodiment, the present invention is not limited to this magnification. The line sensor camera 205 is a monochrome camera. An image inputted by the line sensor camera 205 is formed with minimal pixel units to which the image processing unit can resolute (the present apparatus utilizes an A/D converter having 8 bits), and each minimal pixel can express luminance level in 256 tones, between 0 and 255 tone, in accordance with the intensity of the transmitted light through each pixel.

Next, a method of measuring density of a line pattern (corresponding to the amount of ink discharged from each nozzle) will be explained.

In the present embodiment, density is expressed by the following equation:

$$\text{pixel density} = \text{Log}(\text{pixel reference luminance}/\text{pixel luminance}) \quad (1)$$

and is hereinafter described in detail. In the present embodiment, the density of a line pattern is determined by how much of the incidented light is absorbed while transmitting through the line pattern with color (density) which is subjected to measurement. The higher the density of the line pattern subjected to measurement, the more light is absorbed, and the intensity of the transmitted light decreases. Therefore, the luminance level of the minimum pixel in the area of the line pattern, subjected to measurement, decreases. On the contrary, if the density of the line pattern is low, the luminance level of the minimum pixel must be high. The present embodiment focuses upon this fact, and the density is replaced by light absorbances (although what the image processing unit 1 actually measures is a luminance level).

Figure 21:
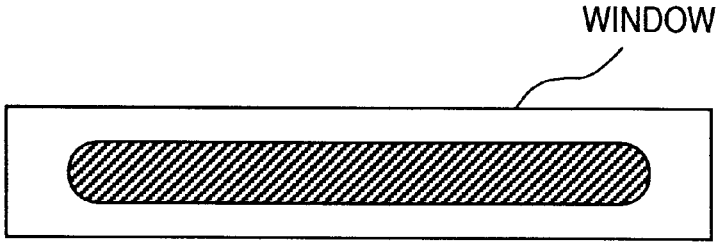
FIG. 21 shows an example when a line pattern subjected to measurement is marked by a window having a fixed size.
Figure 22:
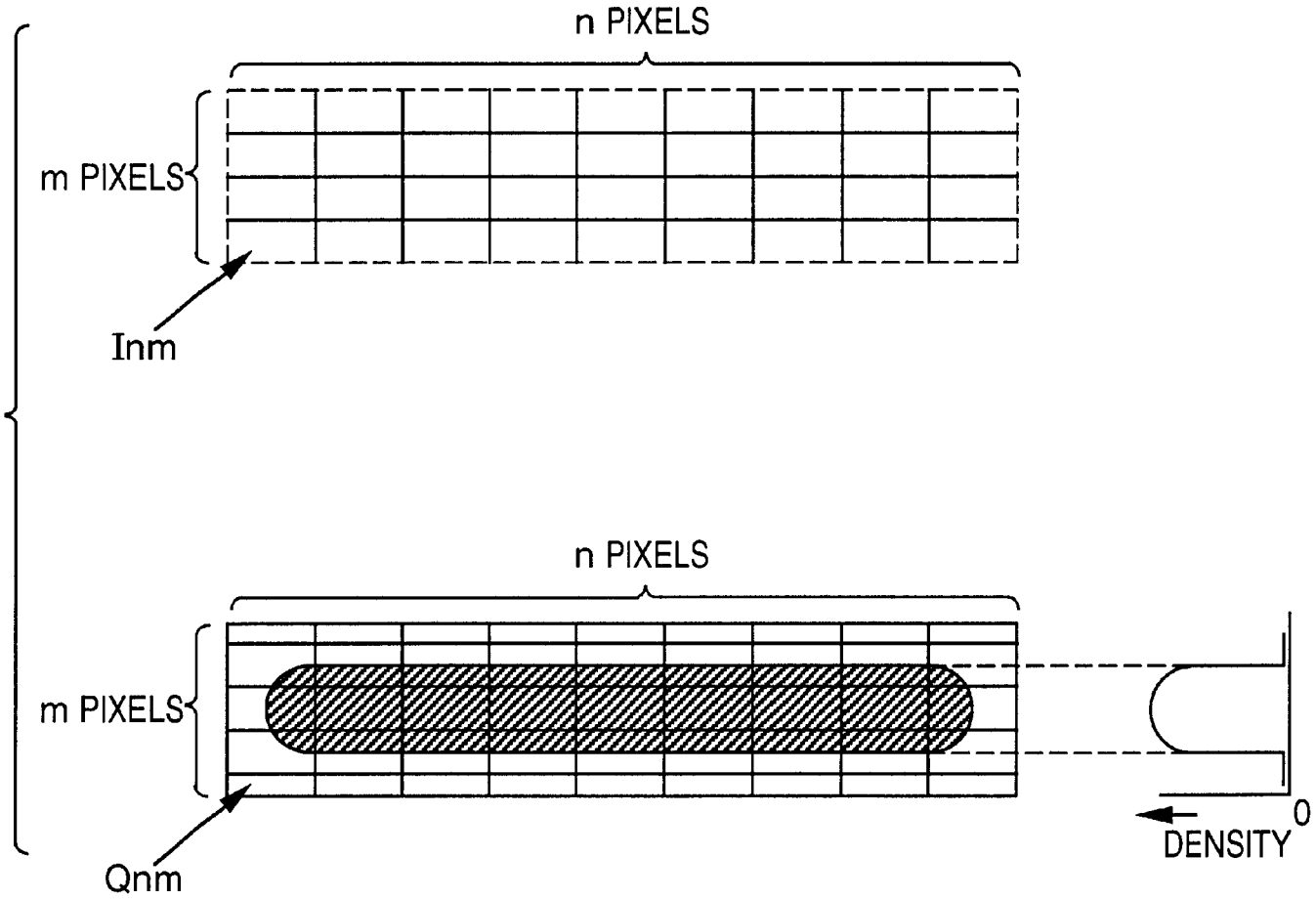
FIG. 22 shows how the window is divided for each pixel.

Then, an image of a line pattern subjected to measurement, inputted by the line sensor camera as described above, is marked by a frame having a fixed size (hereinafter referred to as a "window") as shown in FIG. 21. The window consists of n×m pixels as shown in FIG. 22 (since the line sensor camera is used, the image as shown in FIG. 22 is obtained by scanning in the widthwise direction of the line pattern for the amount of m pixels). Herein, a luminance level of each pixel (pixel luminance: Qnm) is obtained. Furthermore, an image of a portion having no line patterns (the portion of plain glass) is marked by the window having the same size, and the luminance level (pixel reference luminance: Inm) of each pixel is obtained. The pixel reference luminance is shown in FIG. 22 where a window is drawn by broken lines. Then, pixel density with respect to each of the corresponding pixels is calculated by the following equation based on the aforementioned equation (1):

$$\text{pixel density } Dnm = \text{Log}(\text{pixel reference luminance } Inm/\text{pixel luminance } Qnm) \quad (2)$$

By using equation (2), density for each pixel is obtained. All of the pixel density Dnm, obtained with respect to n=1~n, m=1~m (i.e., density of all pixels in the window) are summed up to obtain density of the entire window.

The window size may be arbitrarily determined in consideration with the size of the line pattern to be measured (it should be noted that the window size must be at least large enough to include the entire line pattern). If the window size is set too large for the line pattern, a pixel around the line pattern, where density is low, will have pixel density Inm≈Qnm. Substituting this into equation (2), the following equation is obtained:

$$\text{pixel density } Dnm = \text{Log}(Inm/Qnm) \approx \text{Log } 1 = 0 \quad (3)$$

More specifically, if the window too large in size is marked on the line pattern, pixels around the line pattern where density is low will have pixel density≈0. Thus, even if the pixel density≈0 is added, the sum of the pixel density in the window does not change much. In other words, if the window too large in size is marked on the line pattern, the obtained density will substantially represent only the portion of the line pattern. Therefore, according to the method of the present embodiment, correct density of the line pattern is calculated regardless of the window size.

The XY control stage 204 is controlled by the PC 202 to serially read the line pattern. Then, by marking the line pattern with the window, density of the entire line pattern can be obtained.

On the basis of the density of the line pattern obtained in the foregoing manner, the amount of ink discharged by single discharging operation of a nozzle, which has printed the line pattern, is obtained by utilizing a calibration line described with reference to FIG. 4.

Note that assuming that the line pattern is formed by ink discharged for fifty times, the density of the line pattern obtained above is the sum of density of ink dots corresponding to the fifty times of ink discharged. Therefore, to find an amount of ink discharged by single discharging operation based on the calibration line, the density of the line pattern is divided by the number of times of ink discharged to form the line pattern.

The present invention is not limited to the above embodiments, and various changes and modifications can be made within the spirit and scope of the present invention.

Each apparatus described in the embodiments described above comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called an on-demand type and a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum printing medium which can be printed by the printer, either the arrangement which satisfies the full-line length by combining a plurality of printheads as disclosed in the above specification or the arrangement as a single printhead obtained by forming printheads integrally can be used.

In addition, not only an exchangeable chip type printhead which can be electrically connected to the apparatus main unit and can receive an ink from the apparatus main unit upon being mounted on the apparatus main unit but also a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the printing operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

According to the present invention as described above, by measuring density of an ink dot or a line of a line pattern formed with ink discharged from a head and finding the amount of ink discharged on the basis of the measured density, the amount of ink discharged can be obtained instantly by each dot.

Further, by finding correlation between the amount of ink discharged and the density of an ink dot formed by the discharged ink in advance, the amount of ink discharged from an arbitrary nozzle can be easily found by referring to the correlation and the measured density of the ink dot or the line formed by the ink discharged from the nozzle.

Furthermore, it is possible to instantly obtain the density of the ink dot or the line pattern by forming ink dots or a line pattern on a transparent plate, inputting an image of them by using a camera while illuminating the ink dots or the line pattern with light, and applying image processing to the input image.

Further, by using at least two nozzles whose discharging amounts are known, and finding a calibration line showing relationship between the density of ink dot formed by an ink discharged from the nozzles and the amount of ink discharged in advance, the amount of ink discharged from an arbitrary nozzle under an arbitrary condition can be determined from the calibration line and the density of an ink dot or a line of a line pattern formed with the ink discharged from the arbitrary nozzle.

Further, in order to determine the amount of ink discharged from a nozzle in advance, the weighing method or the absorbance method can be used, thereby the amount of ink discharged from the nozzle can be correctly determined.

Furthermore, it is possible to measure density of a plurality of dots or lines of a line pattern continuously by providing the XY stage or the X stage capable of moving with respect to a camera which performs image processing on an ink absorbent medium. Thereby, amounts of ink discharged from a plurality of nozzles of a printhead can be measured continuously.

Furthermore, by providing an apparatus for measuring an amount of ink in an printing apparatus, it becomes possible to feed back data on the discharged amount of ink obtained in the measuring apparatus to the printing apparatus so that the data is used to control an amount of ink to be discharged by a uniform amount. Accordingly, printing quality can be improved.

Moreover, by calculating density of each pixel in the line pattern and integrating the density of each pixel for the entire line pattern, even in a case where the density of the line pattern is not uniform in the same line pattern, it is possible to obtain correct density of the entire line, thus, obtaining a correct amount of discharged ink.

The present invention is not limited to the above embodiments and various changes and modifications can be made within the spirit and scope of the present invention. Therefore, to appraise the public of the scope of the present invention, the following claims are made.

What is claimed is:

1. A method of determining an amount of ink discharged from a single nozzle of an ink-jet head in a single discharging operation, said method comprising:

a density information obtaining step of obtaining information corresponding to a density of at least one ink dot formed by ink discharged from the single nozzle of ink-jet head on a predetermined material; and an ink discharging amount information obtaining step of obtaining information corresponding to an amount of ink discharged in a single discharging operation based on the information corresponding to density of the ink dot obtained in said density information obtaining step and calibration data representing correlation between an amount of discharged ink and a density of an ink dot.

2. The method according to claim 1, further comprising a preliminary measuring step of finding said calibration data representing correlation between an amount of discharged ink and a density of an ink dot formed by the discharged ink based on experiment prior to said density information obtaining step.

3. The method according to claim 1, wherein the predetermined material is a transparent plate, and in said density information obtaining step, the information corresponding to density of the ink dot is obtained by analyzing light transmitted through the ink dot emitted by a light source which is placed behind the transparent plate in image processing.

4. The method according to claim 1, further comprising a discharging amount adjusting step of adjusting an amount of ink to be discharged so as to become a desired amount on the basis of the information corresponding to amount of ink discharged obtained in said ink discharging amount information obtaining step.

5. The method according to claim 4, further comprising a discharging step of discharging ink onto a printing medium after said discharging amount adjusting step.

6. The method according to claim 1, wherein the density information obtaining step comprises a first step of illuminating an area including the image of said at least one ink dot, and a second step of measuring the amount of light received from said illuminated area.

7. The method according to claim 6, further comprising a step of defining a window including said at least one ink dot, wherein said first step comprises illuminating said window, and said second step comprises measuring the amount of light received from said illuminated window.

8. A method of measuring an amount of ink discharged from a single nozzle of an ink-jet head in a single discharging operation, said method comprising:

a preliminary measuring step of preliminarily measuring an amount of ink discharged from each of a plurality of ink-discharging nozzles of the ink-jet head in a single discharging operation under a predetermined condition;

a first density measuring step of measuring densities of ink dots made of ink discharged from at least two different ink-discharging nozzles which discharge different amounts of ink from each other out of the plurality of ink-discharging nozzles onto a predetermined material under the predetermined condition;

a calibration data generating step of generating a calibration data representing correlation between an amount of ink discharged in a single discharging operation and a density of an ink dot based on data on the densities of the ink dots, measured in said first density measuring step, formed with the ink discharged from the at least two ink-discharging nozzles and data on the amount of ink, measured in said preliminary measuring step, discharged from the at least two ink-discharging nozzles;

a second density measuring step of measuring a density of at lest one ink dot formed by ink discharged from an arbitrary single nozzle of the ink-jet head under an arbitrary condition; and a determining step of determining an amount of ink discharged from the arbitrary single nozzle under the arbitrary condition based on the data on the density of the ink dot, obtained in said second density measuring step, and the calibration data.

9. The method according to claim 8, wherein, in said preliminary measuring step, the amount of ink discharged from each of the plurality of ink-discharging nozzles is measured by a weighing method or an absorbance method.

10. The method according to claim 8, wherein the predetermined material is a transparent plate, and in said first and second density measuring steps, a density of an ink dot is measured by analyzing light transmitted through the ink dot emitted by a light source which is placed behind the transparent plate in image processing.

11. The method according to claim 8, further comprising a discharging amount adjusting step of adjusting an amount of ink to be discharged so as to become a desired amount on the basis of the amount of ink discharged determined in said determining step.

12. The method according to claim 11, further comprising a discharging step of discharging ink onto a printing medium after said discharging amount adjusting step.

13. An apparatus for determining an amount of ink discharged from a single nozzle an ink-jet head in a single discharging operation, said apparatus comprising:

receiving medium for receiving ink discharged from the ink-jet head;

density information obtaining means for obtaining information corresponding to a density of at least one ink dot formed by ink discharged from the single nozzle of the ink-jet head on the receiving medium;

memory means for storing a calibration data representing correlation between an amount of discharged ink and a density of an ink dot formed by the discharged ink on the receiving medium; and operation means for finding an amount of the discharged ink in a single discharging operation based on the information corresponding to density of the ink dot obtained by said density information obtaining means and the calibration data.

14. The apparatus according to claim 13, wherein said density information obtaining means includes a camera for inputting an image of the ink dot and image processing means for analyzing the image inputted by said camera.

15. The apparatus according to claim 13, wherein said receiving medium is a transparent plate, and the apparatus further comprises a light source for illuminating the ink dot from behind the receiving medium.

16. The apparatus according to claim 14, further comprising an XY stage for moving said receiving medium with respect to said camera in order to consecutively and automatically obtain information corresponding to densities of a plurality of ink dots formed on the receiving medium, and consecutively finding amounts of discharged ink forming the plurality of ink dots.

17. The apparatus according to claim 13, further comprising adjusting means for adjusting an amount of ink to be discharged from the ink-jet head based on the amount of ink discharged found by said operation means.

18. A printing apparatus having a function of determining an amount of ink discharged from a single nozzle of an ink-jet head which prints by discharging ink from the ink-jet head in a single discharging operation, said apparatus comprising:

density information obtaining means for obtaining information corresponding to a density of at least one ink dot formed by ink discharged from the single nozzle of the ink-jet head on a receiving medium for receiving the discharged ink;

memory means for storing a calibration data representing correlation between an amount of discharged ink and a density of an ink dot formed by the discharged ink on the receiving medium; and operation means for finding an amount of the discharged ink in a single discharging operation based on the information corresponding to density of the ink dot obtained by said density information obtaining means and the calibration data.

19. The printing apparatus according to claim 18, wherein said density information obtaining means includes a camera for inputting an image of the ink dot and image processing means for analyzing the image inputted by said camera.

20. The printing apparatus according to claim 19, wherein said receiving medium is a transparent plate, and the apparatus further comprises a light source for illuminating the ink dot from behind the receiving medium.

21. The printing apparatus according to claim 19, further comprising an XY stage for moving said receiving medium with respect to said camera in order to consecutively and automatically obtain information corresponding to densities of a plurality of ink dots formed on the receiving medium, and consecutively finding amounts of discharged ink forming the plurality of ink dots.

22. The printing apparatus according to claim 18, further comprising adjusting means for adjusting an amount of ink to be discharged from the ink-jet head based on the amount of ink discharged found by said operation means.

23. A method of determining an amount of ink discharged from a single nozzle of an ink-jet head adopted by a printing apparatus having the ink-jet head, said method comprising:

a density information obtaining step of obtaining information corresponding to a density of at least one ink dot formed by ink discharged from the single nozzle of the ink-jet head on a receiving medium for receiving the discharged ink; and an ink discharging amount information obtaining step of obtaining information corresponding to an amount of ink discharged in a single discharging operation based on the information corresponding to density of the ink dot obtained in said density information obtaining step and calibration data representing correlation between an amount of discharged ink and a density of an ink dot.

24. The method adopted by a printing apparatus according to claim 23, further comprising a preliminary measuring step of finding said calibration data representing correlation between an amount of discharged ink and a density of an ink dot formed by the discharged ink based on experiment prior to said density information obtaining step.

25. The method adopted by a printing apparatus according to claim 23, wherein the receiving medium is a transparent plate, and in said density information obtaining step, the information corresponding to density of the ink dot is obtained by analyzing light transmitted through the ink dot emitted by a light source which is placed behind the receiving medium in image processing.

26. The method adopted by a printing apparatus according to claim 23, further comprising a discharging amount adjusting step of adjusting an amount of ink to be discharged so as to become a desired amount on the basis of the information corresponding to amount of ink discharged obtained in said ink discharging amount information step.

27. The method according to claim 26, further comprising a discharging step of discharging ink onto a printing medium after said discharging amount adjusting step.

28. The method according to claim 23, wherein the density information obtaining step comprises a first step of illuminating an area including the image of said at least one ink dot, and a second step of measuring the amount of light received from said illuminated area.

29. The method according to claim 28, further comprising a step of defining a window including said at least one ink dot, wherein said first step comprises illuminating said window, and said second step comprises measuring the amount of light received from said illuminated window.

30. A method of measuring an amount of ink discharged from a single nozzle of an ink-jet head adopted by a printing apparatus having the ink-jet head, said method comprising:

a preliminary measuring step of preliminarily measuring an amount of ink discharged from each of a plurality of ink-discharging nozzles of the ink-jet head in a single discharging operation under a predetermined condition;

a first density measuring step of measuring densities of ink dots made of ink discharged from at least two different ink-discharging nozzles which discharge different amounts of ink from each other out of the plurality of ink-discharging nozzles onto a receiving medium for receiving ink under the predetermined condition;

a calibration data generating step of generating a calibration data representing correlation between an amount of ink discharged in a single discharging operation and a density of an ink dot based on data on the densities of the ink dots, measured in said first density measuring step, formed with the ink discharged from the at least two ink-discharging nozzles and data on the amount of ink, measured in said preliminary measuring step, discharged from the at least two ink-discharging nozzles;

a second density measuring step of measuring a density of at least one ink dot formed by ink discharged from an arbitrary single nozzle of the ink-jet head under an arbitrary condition; and a determining step of determining an amount of ink discharged from the arbitrary single nozzle under the arbitrary condition based on the data on density of the ink dot, obtained in said second density measuring step, and the calibration data.

31. The method adopted by a printing apparatus according to claim 30, wherein, in said preliminary measuring step, the amount of ink discharged from each of the plurality of ink-discharging nozzles is measured by a weighing method or an absorbance method.

32. The method adopted by a printing apparatus according to claim 30, wherein the receiving medium is a transparent plate, and in said first and second density measuring steps, a density of an ink dot is measured by analyzing light transmitted through the ink dot emitted by a light source which is placed behind the receiving medium in image processing.

33. The method adopted by a printing apparatus according to claim 30, further comprising a discharging amount adjusting step of adjusting an amount of ink to be discharged so as to become a desired amount on the basis of the amount of ink discharged determined in said determining step.

34. The method according to claim 33, further comprising a discharging step of discharging ink onto a printing medium after said discharging amount adjusting step.

35. A method of determining an amount of ink discharged from a single nozzle of an ink-jet head in a single discharging operation, said method comprising:

a density information obtaining step of obtaining information corresponding to a density of a line of a line pattern formed with ink discharged from the single nozzle of the ink-jet head on a predetermined material; and an ink discharging amount information obtaining step of obtaining information corresponding to an amount of ink discharged in a single discharging operation based on the information corresponding to density of the line of the line pattern obtained in said density information obtaining step and calibration data representing correlation between an amount of discharged ink and a density of an ink dot.

36. The method according to claim 35, further comprising a preliminary measuring step of finding said calibration data correlation between an amount of discharged ink and a density of an ink dot formed by the discharged ink based on experiment prior to said density information obtaining step.

37. The method according to claim 35, wherein the predetermined material is a transparent plate, and in said density information obtaining step, the information corresponding to density of the line of the line pattern is obtained by analyzing light transmitted through the line of the line pattern emitted by a light source which is placed behind the transparent plate in image processing.

38. The method according to claim 35, further comprising a discharging amount adjusting step of adjusting an amount of ink to be discharged so as to become a desired amount on the basis of the information corresponding to amount of ink discharged obtained in said discharging amount information obtaining step.

39. The method according to claim 38, further comprising a discharging step of discharging ink onto a printing medium after said discharging amount adjusting step.

40. The method according to claim 35, wherein the density information obtaining step comprises a first step of illuminating an area including the image of said at least one ink dot, and a second step of measuring the amount of light received from said illuminated area.

41. The method according to claim 40, further comprising a step of defining a window including said at least one ink dot, wherein said first step comprises illuminating said window, and said second step comprises measuring the amount of light received from said illuminated window.

42. A method of measuring an amount of ink discharged from a single nozzle of an ink-jet head in a single discharging operation, said method comprising:

a preliminary measuring step of preliminarily measuring an amount of ink discharged from each of a plurality of ink-discharging nozzles of the ink-jet head in a single discharging operation under a predetermined condition;

a first density measuring step of measuring densities of ink dots made of ink discharged from at least two different ink-discharging nozzles which discharge different amounts of ink from each other out of the plurality of ink-discharging nozzles onto a predetermined material under the predetermined condition;

a calibration data generating step of generating a calibration data representing correlation between an amount of ink discharged in a single discharging operation and a density of an ink dot based on data on the densities of the ink dots, measured in said first density measuring step, formed with the ink discharged from the at least two ink-discharging nozzles and data on the amount of ink, measured in said preliminary measuring step, discharged from the at least two ink-discharging nozzles;

a second density measuring step of measuring a density of a line of a line pattern formed with ink discharged from an arbitrary single nozzle of the ink-jet head under an arbitrary condition; and a determining step of determining an amount of ink discharged from the arbitrary single nozzle under the arbitrary condition based on the data on the density of the line of the line pattern, obtained in said second density measuring step, and the calibration data.

43. The method according to claim 42, wherein, in said preliminary measuring step, the amount of ink discharged from each of the plurality of ink-discharging nozzles is measured by a weighing method or an absorbance method.

44. The method according to claim 42, wherein the predetermined material is a transparent plate, and in said first and second density measuring steps, a density of a line of a line pattern is measured by analyzing light transmitted through the line of the line pattern emitted by a light source which is placed behind the transparent plate in image processing.

45. The method according to claim 42, further comprising a discharging amount adjusting step of adjusting an amount of ink to be discharged so as to become a desired amount on the basis of the amount of ink discharged determined in said determining step.

46. The method according to claim 45, further comprising a discharging step of discharging ink onto a printing medium after said discharging amount adjusting step.

47. An apparatus for determining an amount of ink discharged from a single nozzle of an ink-jet head in a single discharging operation, said apparatus comprising:

receiving medium for receiving ink discharged from the ink-jet head;

density information obtaining means for obtaining information corresponding to a density of a line of a line pattern formed with ink discharged from the single nozzle of the ink-jet head on the receiving medium;

memory means for storing a calibration data representing correlation between an amount of discharged ink and a density of an ink dot formed by the discharged ink on the receiving medium; and operation means for finding an amount of the discharged ink in a single discharging operation based on the information corresponding to density of the line of the line pattern obtained by said density information obtaining means and the calibration data.

48. The apparatus according to claim 47, wherein said density information obtaining means includes a camera for inputting an image of the line of the line pattern and image processing means for analyzing the image inputted by said camera.

49. The apparatus according to claim 48, wherein said receiving medium is a transparent plate, and the apparatus further comprises a light source for illuminating the line of the line pattern from behind the receiving medium.

50. The apparatus according to claim 48, further comprising an XY stage for moving said receiving medium with respect to said camera in order to consecutively and automatically obtain information corresponding to densities of a plurality of lines of the line pattern formed on the receiving medium, and consecutively finding amounts of discharged ink forming the plurality of lines of the line pattern.

51. The apparatus according to claim 47, further comprising adjusting means for adjusting an amount of ink to be discharged from the ink-jet head based on the amount of ink discharged found by said operation means.

52. A method of measuring an amount of ink discharged from a single nozzle of an ink-jet head in a single discharging operation, comprising:

a line pattern forming step of forming a line pattern on a predetermined material by discharging ink from the single nozzle of the ink-jet head onto the predetermined material;

a first image-sensing step of sensing the line pattern by an image sensing device;

a second image-sensing step of sensing a portion other than the line pattern on the predetermined material by the image sensing device;

a density calculating step of calculating density of each pixel of the ink pattern by dividing a luminance value of the portion sensed in said second image-sensing step by a luminance value of the line pattern sensed in said first image-sensing step pixel by pixel of the image sensing device, and calculating a common logarithm thereof;

an integrating step of integrating the density of each pixel of entire line pattern calculated in said density calculating step; and an ink-discharge-amount determining step of obtaining the amount of discharged ink based on the integrated density calculated in said integrating step and calibration data representing correlation between an amount of ink discharged in a single discharging operation and a density of an ink dot.

53. The method of measuring an amount of discharged ink according to claim 52, further comprising a preliminary measuring step of preliminarily obtaining said calibration data representing correlation between the amount of ink discharged by single discharging operation and density of an ink dot formed by the ink, before said ink-discharge-amount determining step.

54. The method of measuring an amount of discharged ink according to claim 52, wherein the predetermined material is a transparent plate, and in said first and second image-sensing steps, light emitted by a light source placed behind the plate and transmitted through the line pattern is sensed.

55. The method of measuring an amount of discharged ink according to claim 52, further comprising a discharge-amount adjusting step of adjusting the amount of discharged ink to a desired amount on the basis of the amount of discharged ink determined in said determining step, after said ink-discharge-amount determining step.

56. The method of measuring an amount of discharged ink according to claim 55, further comprising a discharging step of discharging ink onto a print medium after said discharge-amount-adjusting step.

57. A method of measuring an amount of ink discharged from a single nozzle of an ink-jet head in a single discharging operation, comprising:

a preliminary measuring step of preliminarily measuring an amount of ink discharged from each of a plurality of ink-discharging nozzles of the ink-jet head in a single discharging operation under a predetermined condition;

a first density measuring step of measuring densities of ink dots made of ink discharged from at least two different ink-discharging nozzles which discharge different amounts of ink from each other out of the plurality of ink-discharging nozzles onto a predetermined material under the predetermined condition;

a calibration data generating step of generating a calibration data representing correlation between an amount of ink discharged in a single discharging operation and a density of an ink dot based on data on the densities of the ink dots, measured in said first density measuring step, formed with the ink discharged from the at least two ink-discharging nozzles and data on the amount of ink, measured in said preliminary measuring step, discharged from the at least two ink-discharging nozzles;

a line pattern forming step of forming a line pattern on the predetermined material by discharging ink from an arbitrary single nozzle of the ink-jet head onto the predetermined material under an arbitrary condition;

a first image-sensing step of sensing the line pattern by an image sensing device;

a second image-sensing step of sensing a portion other than the line pattern on the predetermined material by the image sensing device;

a density calculating step of calculating density of each pixel of the line pattern by dividing a luminance value of the portion sensed in said second image-sensing step by a luminance value of the line pattern sensed in said first image-sensing step pixel by pixel of the image sensing device, and calculating a common logarithm thereof;

an integrating step of integrating the density of each pixel of the entire line pattern calculated in said density calculating step; and an ink-discharge-amount determining step of obtaining the amount of ink discharged from the arbitrary single nozzle under the arbitrary condition based on the integrated density calculated in said integrating step and the calibration data.

58. The method of measuring an amount of discharged ink according to claim 57, wherein in said preliminary measuring step, the amount of ink discharged from each of the plurality of ink discharging nozzles is measured by weighing method or absorbance method.

59. The method of measuring an amount of discharged ink according to claim 57, wherein the predetermined material is a transparent plate, and in said first and second image-sensing steps, light emitted by a light source placed behind the plate and transmitted through the line pattern is sensed.

60. The method of measuring an amount of discharged ink according to claim 57, further comprising a discharge-amount adjusting step of adjusting the amount of discharged ink to a desired amount on the basis of the amount of discharged ink determined in said determining step, after said ink-discharge-amount determining step.

61. The method of measuring an amount of discharged ink according to claim 60, further comprising a discharging step of discharging ink onto a print medium after said discharge-amount-adjusting step.

62. An apparatus for measuring an amount of ink discharged from a single nozzle of an ink-jet head in a single discharging operation, comprising:

a receiving medium for receiving ink discharged from the ink-jet head;

an image sensing device for sensing a line pattern, formed with ink discharged from the single nozzle of the ink-jet head on the receiving medium, and a portion other than the line pattern;

first calculating means for calculating density of each pixel by dividing a luminance value of the portion other than the line pattern by a luminance value of the line pattern sensed by said image sensing device pixel by pixel, calculating a common logarithm and integrating the obtained density;

memory means for storing a calibration data representing correlation between the amount of discharged ink and density of an ink dot formed on the receiving medium with discharged ink; and second calculating means for calculating the amount of discharged ink based on the integrated density of the line pattern obtained by said first calculating means and the calibration data.

63. The apparatus for measuring an amount of discharged ink according to claim 62, wherein said receiving medium is a transparent plate, and said apparatus further comprises a light source for emitting light on the line pattern from behind the receiving medium.

64. The apparatus for measuring an amount of discharged ink according to claim 62, further comprising an XY stage for moving said receiving medium with respect to said image sensing device in order to consecutively and automatically measure integrated densities of a plurality of line patterns formed on said receiving medium, and consecutively obtaining each amount of discharged ink forming the plurality of line patterns.

65. The apparatus for measuring an amount of discharged ink according to claim 62, further comprising adjusting means for adjusting the amount of ink discharged from the printhead on the basis of the amount of discharged ink calculated by said second calculating means.

66. A printing apparatus, having a function for measuring an amount of ink discharged from a single nozzle of an ink-jet head in a single discharging operation, for performing printing by utilizing the ink-jet head which discharges ink by ink-jet method, comprising:

a receiving medium for receiving ink discharged from the ink-jet head;

an image sensing device for sensing a line pattern, formed with ink discharged from the single nozzle of the ink-jet head on the receiving medium, and a portion other than the line pattern;

first calculating means for calculating density of each pixel by dividing a luminance value of the portion other than the line pattern by a luminance value of the line pattern sensed by said image sensing device pixel by pixel, calculating a common logarithm and integrating the obtained density;

memory means for storing a calibration data representing correlation between the amount of discharged ink and density of an ink dot formed on the receiving medium with discharged ink; and second calculating means for calculating the amount of discharged ink based on the integrated density of the line pattern obtained by said first calculating means and the calibration data.

67. The printing apparatus according to claim 66, wherein said receiving medium is a transparent plate, and said apparatus further comprises a light source for emitting light on the line pattern from behind the receiving medium.

68. The printing apparatus according to claim 66, further comprising an XY stage for moving said receiving medium with respect to said image sensing device in order to consecutively and automatically measure densities of a plurality of line patterns formed on said receiving medium, and consecutively obtaining the amount of discharged ink forming the plurality of line patterns.

69. The printing apparatus according to claim 66, further comprising adjusting means for adjusting the amount of ink discharged from the ink-jet head based on the amount of discharged ink calculated by said second calculating means.

70. A method of measuring an amount of ink discharged from a single nozzle of an ink-jet head in a printing apparatus having the ink-jet head, comprising:

a line pattern forming step of forming a line pattern on a predetermined material by discharging ink from the single nozzle of the ink-jet head onto the predetermined material;

a first image-sensing step of sensing the line pattern by an image sensing device;

a second image-sensing step of sensing a portion other than the line pattern on the predetermined material by the image sensing device;

a density calculating step of calculating density of each pixel of the line pattern by dividing a luminance value of the portion sensed in said second image-sensing step by a luminance value of the line pattern sensed in said first image-sensing step pixel by pixel of the image sensing device, and calculating a common logarithm thereof;

an integrating step of integrating the density of each pixel of the entire line pattern calculated in said density calculating step; and an ink-discharge-amount determining step of obtaining the amount of discharged ink based on the integrated density calculated in aid integrating step and calibration data representing correlation between an amount of ink discharged in a single discharging operation and a density of an ink dot.

71. The method of measuring an amount of discharged ink in the printing apparatus according to claim 70, further comprising a preliminary measuring step of preliminarily obtaining said calibration data representing correlation between the amount of ink discharged by single discharging operation and density of an ink dot formed by the ink, before said ink-discharge-amount determining step.

72. The method of measuring an amount of discharged ink in the printing apparatus according to claim 70, wherein the predetermined material is a transparent plate, and in said first and second image-sensing steps, light emitted by a light source placed behind the plate and transmitted through the line pattern is sensed.

73. The method of measuring an amount of discharged ink in the printing apparatus according to claim 70, further comprising a discharge-amount adjusting step of adjusting the amount of discharged ink to a desired amount on the basis of the amount of discharged ink determined in said determining step, after said ink-discharge-amount determining step.

74. The method of measuring an amount of discharged ink in the printing apparatus according to claim 73, further comprising a discharging step of discharging ink to a print medium after said discharge-amount-adjusting step.

75. A method of measuring an amount of ink discharged from a single nozzle of an ink-jet head in a printing apparatus having the ink-jet head, comprising:

a preliminary measuring step of preliminarily measuring an amount of ink discharged from each of a plurality of ink-discharging nozzles of the ink-jet head in a single discharging operation under a predetermined condition;

a first density measuring step of measuring densities of ink dots made of ink discharged from at least two different ink-discharging nozzles which discharge different amounts of ink from each other out of the plurality of ink-discharging nozzles onto a predetermined material under the predetermined condition;

a calibration data generating step of generating a calibration data representing correlation between an amount of ink discharged in a single discharging operation and a density of an ink dot based on data on the densities of the ink dots, measured in said first density measuring step, formed with the ink discharged from the at least two ink-discharging nozzles and data on the amount of ink, measured in said preliminary measuring step, discharged from the at least tow ink-discharging nozzles;

a line pattern forming step of forming a line pattern on the predetermined material by discharging ink from an arbitrary single nozzle of the ink-jet head onto the predetermined material under an arbitrary condition;

a first image-sensing step of sensing the line pattern by an image sensing device;

a second image-sensing step of sensing a portion other than the line pattern on the predetermined material by the image sensing device;

a density calculating step of calculating density of each pixel of the line pattern by dividing a luminance value of the portion sensed in said second image-sensing step by a luminance value of the line pattern sensed in aid first image-sensing step pixel by pixel of the image sensing device, and calculating a common logarithm thereof;

an integrating step of integrating the density of each pixel of the entire line pattern calculated in said density calculating step; and an ink-discharge-amount determining step of obtaining the amount of ink discharged from the arbitrary single nozzle under the arbitrary condition based on the integrated density calculated in said integrating step and the calibration data.

76. The method of measuring an amount of ink discharged in the printing apparatus according to claim 75, wherein in said preliminary measuring step, the amount of ink discharged from each of the plurality of ink discharging nozzles is measured by weighing method or absorbance method.

77. The method of measuring an amount of ink discharged in the printing apparatus according to claim 75, wherein the predetermined material is a transparent plate, and in said first and second image-sensing steps, light emitted by a light source placed behind the plate and transmitted through the line pattern is sensed.

78. The method of measuring an amount of ink discharged in the printing apparatus according to claim 75, further comprising a discharge-amount adjusting step of adjusting the amount of discharged ink to a desired amount on the basis of the amount of discharged ink determined in said determining step, after said ink-discharge-amount determining step.

79. The method of measuring an amount of ink discharged in the printing apparatus according to claim 78, further comprising a discharging step of discharging ink to a print medium after said discharge-amount-adjusting step.

80. A method of measuring an amount of ink discharged from a single nozzle of an ink-jet head in a single discharging operation, comprising:

a line pattern forming step of forming a line pattern on a predetermined material by discharging ink from the single nozzle of the ink-jet head onto the predetermined material;

a first image-sensing step of sensing the line pattern by an image sensing device;

a second image-sensing step of sensing a portion other than the line pattern on the predetermined material by the image sensing device;

a density calculating step of calculating density of each pixel of the line pattern by dividing a luminance value of the portion sensed in said second image-sensing step by a luminance value of the line pattern sensed in said first image-sensing step pixel by pixel of the image sensing device, and calculating a common logarithm thereof;

an integrating step of integrating the density of each pixel of the entire line pattern calculated in said density calculating step; and an ink-discharge-amount determining step of determining the amount of discharged ink on the basis of the integrated density calculated in said integrating step and calibration data representing correlation between an amount of discharged ink and a density of an ink dot.

81. A method of measuring an amount of ink discharged from a single nozzle of an ink-jet head in a printing apparatus having the ink-jet head, comprising:

a line pattern forming step of forming a line pattern on a predetermined material by discharging ink from the single nozzle of the ink-jet head onto the predetermined material;

a first image-sensing step of sensing the line pattern by an image sensing device;

a second image-sensing step of sensing a portion other than the line pattern on the predetermined material by the image sensing device;

a density claculating step of calculating density of each pixel of the line pattern by dividing a luminance value of the portion sensed in said second image-sensing step by a luminance value of the line pattern sensed in said first image-sensing step pixel by pixel of the image sensing device, and calculating a common logarithm thereof;

an integrating step of integrating the density of each pixel of the entire line pattern calculated in said density calculating step; and an ink-discharge-amount determining step of determining the amount of discharged ink on the basis of the integrated density calculated in said integrating step and calibration data representing correlation between an amount of discharged ink and a density of an ink dot.

* * * * *